US007029188B2

(12) United States Patent
Ochiai

(10) Patent No.: US 7,029,188 B2
(45) Date of Patent: Apr. 18, 2006

(54) IMAGE FORMING APPARATUS, IMAGE FORMING APPARATUS SETUP SYSTEM, AND IMAGE FORMING APPARATUS SETUP METHOD

(75) Inventor: Kanenori Ochiai, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 33 days.

(21) Appl. No.: 10/921,985

(22) Filed: Aug. 20, 2004

(65) Prior Publication Data

US 2005/0042008 A1 Feb. 24, 2005

(30) Foreign Application Priority Data

Aug. 20, 2003 (JP) ..... 2003-208092

(51) Int. Cl.
*B41J 11/06* (2006.01)
*G03D 3/08* (2006.01)

(52) U.S. Cl. ..... 400/40; 396/613

(58) Field of Classification Search ..... 400/40; 396/613, 564; 355/40, 72, 41; 134/64 R
See application file for complete search history.

(56) References Cited

U.S. PATENT DOCUMENTS

| | | | | |
|---|---|---|---|---|
| 4,602,778 | A | 7/1986 | Hirose et al. | 271/227 |
| 4,864,355 | A * | 9/1989 | Knecht et al. | 355/27 |
| 5,432,586 | A * | 7/1995 | Tokuda | 355/41 |
| 5,600,498 | A * | 2/1997 | Motooka et al. | 360/3 |
| 5,678,111 | A * | 10/1997 | Matsumoto | 396/564 |
| 5,857,128 | A * | 1/1999 | Matsumoto | 396/612 |
| 5,953,104 | A * | 9/1999 | Matsumoto | 355/40 |
| 5,963,757 | A * | 10/1999 | Factor | 399/40 |
| 6,040,896 | A * | 3/2000 | Motooka | 355/72 |
| 6,115,103 | A * | 9/2000 | Iwai | 355/40 |
| 6,118,950 | A * | 9/2000 | Wibbels et al. | 399/16 |
| 6,130,998 | A * | 10/2000 | Ochiai | 396/612 |
| 6,135,448 | A * | 10/2000 | Daito | 271/270 |
| 6,172,736 | B1 * | 1/2001 | Yamamoto | 355/28 |
| 6,409,400 | B1 * | 6/2002 | Arai | 396/612 |
| 6,513,539 | B1 * | 2/2003 | Tanaka | 134/64 P |
| 6,773,180 | B1 * | 8/2004 | Tsuji et al. | 400/608.4 |
| 2001/0045225 | A1 | 11/2001 | Tanaka | 134/64 R |

FOREIGN PATENT DOCUMENTS

| | | |
|---|---|---|
| JP | 60-153358 A | 8/1985 |
| JP | 11-349191 A | 12/1999 |
| JP | 2002-55422 A | 2/2002 |

* cited by examiner

*Primary Examiner*—Daniel J. Colilla
*Assistant Examiner*—Wasseem H. Hamdan
(74) *Attorney, Agent, or Firm*—Birch, Stewart, Kolasch & Birch, LLP

(57) ABSTRACT

The image forming apparatus includes a printer that performs image printing on the sheet members supplied at preset intervals at the first transport speed and a processor that performs development processing on the printed sheet members transported at the second transport speed. The printer includes a distribution unit and a control section. The distribution unit distributes the sheet members into plural lines while transporting the sheet members at the first transport speed. The distribution unit is replaceable and has a distribution processing capacity corresponding with the sheet output amount per unit time required by the image forming apparatus. The control section controls one or both of the sheet supply intervals and the sheet distribution speed in accordance with the sheet output amount.

18 Claims, 12 Drawing Sheets

IMAGE FORMING APPARATUS, IMAGE FORMING APPARATUS SETUP SYSTEM, AND IMAGE FORMING APPARATUS SETUP METHOD

This Non-provisional application claims priority under 35 U.S.C. § 119(a) on Patent Application No(s). 2003-208092 filed in Japan on Aug. 20, 2003, the entire contents of which are hereby incorporated by reference.

BACKGROUND OF THE INVENTION

The present invention relates to an image forming apparatus including a printer that transports sheet members supplied at constant supply intervals at a predetermined first transport speed and performs image printing onto the sheet members and a processor that transports the sheet members subjected to the image printing at a predetermined second transport speed and performs development processing on the sheet members, an image forming apparatus setup system, and an image forming apparatus setup method. In particular, the present invention relates to an image forming apparatus including a replaceable distributor having a distribution processing capacity corresponding with a required sheet output amount per unit time and a control section for adjusting at least one of sheet supply intervals and a distribution speed, an image forming apparatus setup system including a distributor group containing multiple kinds of distributors whose distribution processing capacities have been prescribed based on distribution speeds and which include a distributor that does not distribute sheet members into multiple lines, where an image forming apparatus is set up using a distributor selected from the distributor group in accordance with a required sheet output amount per unit time, and an image forming apparatus setup method using a distributor group containing multiple kinds of distributors, whose distribution processing capacities have been prescribed based on distribution speeds and which include a distributor that does not distribute sheet members into multiple lines, and an adjuster group containing multiple adjusters for adjusting at least one of sheet supply intervals and a sheet distribution speed in accordance with a required sheet output amount per unit time, where an image forming apparatus is set up using a distributor selected from the distributor group and an adjuster selected from the adjuster group in accordance with the output amount.

In recent years, an image forming apparatus has been put into practical use which obtains a digital signal by photoelectrically reading an image recorded on a film, generates image data for recording by performing various kinds of image processing on the digital signal, records the image on a photosensitive material by scanning and exposing the photosensitive material with a light beam modulated in accordance with the image data, performs development processing on the exposed photosensitive material, and outputs the processed photosensitive material as a print (photograph).

This image forming apparatus basically includes: an input machine having a scanner (image reading device) and an image processing device; and an output machine having a printer (image recording device) and a processor (developing apparatus).

The scanner obtains data of the image taken on the film (image data signal) by photoelectrically reading projection light from the image on the film with an image sensor, such as a CCD sensor, and sends the image data signal to the image processing apparatus. The image processing apparatus performs predetermined image processing on the image data and sends resultant data to the printer as image data for image recording (exposure conditions).

When the printer is of the type which utilizes light beam scanning exposure, cut sheets of photosensitive material obtained by cutting a roll of long photosensitive material into a predetermined length, are transported to an exposure position. At the same time, a light beam modulated according to the supplied image data is deflected in a one-dimensional direction, that is, in the main scanning direction and impinges on the photosensitive material and, further, the photosensitive material is scanned and transported in a sub scanning direction perpendicular to the main scanning direction to thereby two-dimensionally scan the photosensitive material by exposure to the light beam to form a latent image. In the processor, predetermined development processing is performed on the photosensitive material that has been subjected to exposure (hereinafter also referred to as simply the "exposed photosensitive material"), and a print is obtained on which the image photographed on the film is reproduced.

In such a digital photo printer, in order to efficiently output a large amount of prints, it is necessary to scan a photosensitive material by exposure in a short time and perform the development thereon. Thus, it is necessary to achieve an improvement in the processing efficiency of the development, and, in order to perform the development while transporting the photosensitive material in a plurality of lines, there have been proposed various distributing devices for transporting the photosensitive material in plural lines through distribution.

In particular, in a digital photo printer in which scanning and exposure are performed on a photosensitive material being transported while deflecting a light beam within a predetermined range, it is desirable to avoid a situation in which the image to be recorded is recorded on the photosensitive material in an inclined state or recorded in an offset state; in this respect, it is desirable to perform post-exposure distribution in which, after recording on a photosensitive material by exposure, the photosensitive material is distributed into plural lines and transported.

In addition, in the processor, a unification unit is provided which unifies photosensitive materials transported in plural lines into a single line after development processing and dry processing. The photosensitive materials unified into the single line by the unification unit are then sorted and accumulated by a sorter in units of one roll of film or the like.

Also, as to such an image forming apparatus, there is also a case where several types of image forming apparatuses having similar external appearances and different performance specifications are designed with a common printer or processor and these image forming apparatuses are brought to market as serialized models.

When such serialized models are constructed based on a conventional image forming apparatus, however, only the printer or processor is set as a common component and other components are designed specifically for the respective models. Therefore, in such serialized models, the commonality ratio of components is low and different control methods are used in the respective models. Consequently, there occurs a problem in that the development cost and design cost of the serialized models are increased.

Also, in the case of a conventional image forming apparatus, when it is desired to increase its print output processing capacity per unit time, it is required to change the specifications of the image forming apparatus by, for instance, bringing the image forming apparatus to a factory and replacing its printer or processor with another one having a higher processing capacity. Therefore, there occurs an inconvenience in that it is impossible to run business during the modification at the factory, a huge cost is required for the modification, and so on.

SUMMARY OF THE INVENTION

The present invention has been made in order to solve the problems described above and has an object to provide an image forming apparatus, an image forming apparatus setup system, and an image forming apparatus setup method, with which it is possible to cope with a required output amount, such as a required number of sheets to be printed per unit time, through minimum replacement or adjustment of units.

Also, the present invention has another object to provide an image forming apparatus, an image forming apparatus setup system, and an image forming apparatus setup method, with which it is possible to change a currently set output amount, such as a currently set number of sheets to be printed per unit time, through minimum replacement or adjustment of units.

In order to attain the above-mentioned object, a first aspect of the present invention provides an image forming apparatus, comprising: a printer that transports sheet members supplied at preset sheet supply intervals at a predetermined first transport speed and performs image printing on the sheet members; and a processor that transports the sheet members subjected to the image printing at a predetermined second transport speed and performs development processing on the sheet members subjected to the image printing, and outputs the sheet members subjected to the development processing, wherein: the printer includes: a distributor that distributes the sheet members into plural lines to transport the distributed sheet members in the plural lines in accordance with a sheet output amount per unit time required by the image forming apparatus, while transporting the sheet members at the first transport speed, the distributor being replaceable and having a distribution processing capacity corresponding with the sheet output amount; and a control section that controls in accordance with the sheet output amount at least one of the sheet supply intervals for the sheet members transported at the first transport speed and a sheet distribution speed at which the sheet members are distributed while being transported at the first transport speed when the distributor is capable of adjusting the sheet distribution speed.

It is preferable that the processor includes: a development processing section that performs the development processing on the sheet members subjected to the image printing and transported in the plural lines at the second transport speed; and a unificator that unifies the sheet members which are subjected to the development processing and distributed in the plural lines into a single line, and transports the unified sheet members in the single line, the unificator being replaceable and having a unification processing capacity corresponding with the sheet output amount and being capable of adjusting a unification speed at which the distributed sheet members in the plural lines are unified into the single line.

It is also preferable that the image forming apparatus further comprises: an automatic recognition processing section that recognizes the distributor and the unificator and adjusts at least one of the sheet supply intervals and the sheet distribution speed controlled by the control section in accordance with the sheet output amount.

It is also preferable that the processor further comprises: a sorter that is connected to the unificator and sorts the plural sheet members unified by the unificator.

It is also preferable that the printer includes a supply section, the supply section including: a magazine in which a long photosensitive material is contained; a drawing-out unit that draws out the long photosensitive material from the magazine; and a cutter that cuts the long photosensitive material drawn out from the magazine into the sheet members, and wherein the sheet supply intervals controlled by the control section are cutting intervals of the long photosensitive material by the cutter.

It is also preferable that the image forming apparatus further comprising: an automatic recognition processing section that recognizes the distributor and adjusts at least one of the sheet supply intervals and the sheet distribution speed controlled by the control section in accordance with the sheet output amount.

Further, in order to attain the above-mentioned object, a second aspect of the present invention provides an image forming apparatus setup system for setting up an image forming apparatus, the image forming apparatus including: a printer that transports sheet members supplied at preset sheet supply intervals at a predetermined first transport speed and performs image printing on the sheet members; and a processor that transports the sheet members subjected to the image printing at a predetermined second transport speed and performs development processing on the sheet members subjected to the image printing, and outputs the sheet members subjected to the development processing, wherein: the printer includes a first mount portion to which distributor is mounted, the distributor distributing the sheet members into plural lines to transport the distributed sheet members in the plural lines in accordance with a sheet output amount per unit time required by the image forming apparatus, while transporting the sheet members at the first transport speed, the distributor being replaceable and having a distribution processing capacity corresponding with the sheet output amount; and the image forming apparatus setup system comprising: the image forming apparatus; and a distributor group containing plural kinds of distributors whose distribution processing capacities have been prescribed based on sheet distribution speeds at which the sheet members are distributed into the plural lines and a single-line transporter that transports the sheet members in a single line without distributing the sheet members into the plural lines, wherein the image forming apparatus is set up in accordance with the sheet output amount by selecting a distributor corresponding to the sheet output amount from the distributor group and mounting the selected distributor into the first mount portion.

It is also preferable that the distributor is capable of adjusting the sheet distribution speed at which the sheet members are distributed while being transported at the first transport speed.

It is also preferable that the printer further includes control section that controls at least one of the sheet supply intervals and the sheet distribution speed in accordance with the sheet output amount; the image forming apparatus setup system further comprises: an adjuster group containing plural adjusters that adjusts at least one of the sheet supply intervals and the sheet distribution speed controlled by the control section in accordance with the sheet output amount; and an adjuster corresponding to the sheet output amount is selected from the adjuster group, the selected adjuster is set to the control section and the control section controls at least one of the sheet supply intervals and the sheet distribution speed based on the set adjuster.

It is also preferable that the adjuster is adjustment parameters for adjusting at least one of the sheet supply intervals and the sheet distribution speed controlled by the control section in accordance with the sheet output amount, and the adjuster group is an adjustment parameters group containing plural kinds of the adjustment parameters.

It is also preferable that the processor includes: a development processing section that performs the development processing on the sheet members subjected to the image printing and transported in the plural lines at the second transport speed; and a second mount portion to which unificator is mounted, the unificator unifying the sheet members which are subjected to the development processing and distributed in the plural lines into a single line, and transporting the unified sheet members in the single line, the unificator being replaceable and having a unification processing capacity corresponding with the sheet output amount and being capable of adjusting a unification speed at which the distributed sheet members in the plural lines are unified into the single line; and the image forming apparatus setup system further comprising: a unificator group containing plural kinds of unificators whose unification processing capacities have been prescribed based on sheet unification speeds corresponding with the different output amounts and a transporter that transports the sheet members without unifying the sheet members; and a unificator corresponding to the sheet output amount is selected from the unificator group and the selected unificator is mounted to the second mount portion.

It is also preferable that the processor further includes a third mount portion which is connected to the unificator and to which a sorter is mounted, the sorter sorting the sheet members unified by the unificator; the image forming apparatus setup system further comprises: a sorter group containing plural kinds of sorters for sorting the sheet members unified by the unificator corresponding with the different output amounts; and a sorter corresponding to the sheet output amount is selected from the sorter group and the selected sorter is mounted to the third mount portion.

Further, in order to attain the above-mentioned object, a third aspect of the present invention provides an image forming apparatus setup method for setting up an image forming apparatus, the image forming apparatus including: a printer that transports sheet members supplied at preset sheet supply intervals at a predetermined first transport speed and performs image printing on the sheet members; and a processor that transports the sheet members subjected to the image printing at a predetermined second transport speed and performs development processing on the sheet members subjected to the image printing, and outputs the sheet members subjected to the development processing, wherein: the printer includes: a distributor that distributes the sheet members into plural lines to transport the distributed sheet members in the plural lines in accordance with a sheet output amount per unit time required by the image forming apparatus, while transporting the sheet members at the first transport speed, the distributor being replaceable, having a distribution processing capacity corresponding with the sheet output amount and being capable of adjusting a sheet distribution speed at which the sheet members are distributed into the plural lines while the sheet members being transported at the first transport speed; and a control section that controls in accordance with the sheet output amount at least one of the preset sheet supply intervals and the sheet distribution speed; the image forming apparatus setup method comprising the steps of: preparing a distributor group containing plural kinds of distributors whose distribution processing capacities have been prescribed based on sheet distribution speeds at which the sheet members are distributed into the plural lines corresponding with the different output amounts and a single-line transporter that transports the sheet members in a single line without distributing the sheet members into the plural lines, and an adjuster group containing plural adjusters that adjust at least one of the sheet supply intervals and the sheet distribution speed controlled by the control section in accordance with the sheet output amount; selecting a distributor corresponding to the sheet output amount from the distributor group; and selecting an adjuster corresponding to the sheet output amount from the adjuster group.

It is also preferable that the processor includes: a development processing section that performs the development processing on the sheet members subjected to the image printing and transported in the plural lines at the second transport speed; and a unificator that unifies the sheet members which are subjected to the development processing and distributed in the plural lines into a single line, and transports the unified sheet members in the single line, the unificator being replaceable and having a unification processing capacity corresponding with the sheet output amount and being capable of adjusting a unification speed at which the distributed sheet members in the plural lines are unified into the single line; and the image forming apparatus setup method further comprising the steps of: preparing a unificator group containing plural kinds of unificators whose unification processing capacities have been prescribed based on sheet unification speeds corresponding with the different output amounts and a transporter that transports the sheet members without unifying the sheet members; and selecting a unificator corresponding to the sheet output amount from the unificator group.

It is also preferable that the image forming apparatus setup method further comprising the steps of: setting the selected adjuster to the control section, and wherein the control section controls at least one of the sheet supply intervals and the sheet distribution speed based on the set adjuster.

It is also preferable that the adjuster is adjustment parameters that adjusts at least one of the sheet supply intervals and the sheet distribution speed controlled by the control section in accordance with the sheet output amount, and the adjuster group is an adjustment parameters group containing plural kinds of the adjustment parameters.

It is also preferable that the image forming apparatus setup method further comprising the steps of: preparing a sorter group containing plural kinds of sorters being each connected to the unificator and that sorts the sheet members unified by the unificator corresponding with the different output amounts; and selecting a sorter corresponding to the sheet output amount from the sorter group.

Further, in order to attain the above-mentioned object, the present invention provides an image forming apparatus including: a printer that transports sheet members supplied at preset sheet supply intervals at a predetermined first transport speed and performs image printing on the sheet members; and a processor that transports the sheet members subjected to the image printing at a predetermined second transport speed and performs development processing on the sheet members subjected to the image printing, and outputs the sheet members subjected to the development processing, wherein: the printer includes: a distributor that distributs the sheet members into plural lines to transport the distributed sheet members in the plural lines in accordance with a sheet output amount per unit time required by the image forming apparatus, while transporting the sheet members at the first transport speed, the distributor being replaceable, having a distribution processing capacity corresponding with the sheet output amount and being capable of adjusting a sheet distribution speed at which the sheet members are distributed into the plural lines while the sheet members being transported at the first transport speed; and a control section that controls in accordance with the sheet output amount at least one of the preset sheet supply intervals and the sheet distribution speed, and wherein the image forming apparatus is set up with a setup method comprising the steps of: preparing a distributor group containing plural kinds of distributors whose distribution processing capacities have been prescribed based on sheet distribution speeds at which the sheet members are distributed into the plural lines corresponding with the different output amounts and a single-line transporter that transports the sheet members in a single line without distributing the sheet members into the plural lines, and an adjuster group containing plural adjusters that adjust at least one of the sheet supply intervals and the sheet distribution speed controlled by the control section in accordance with the sheet output amount; selecting a distributor corresponding to the sheet output amount from the distributor group; and selecting an adjuster corresponding to the sheet output amount from the adjuster group.

DESCRIPTION OF THE PREFERRED EMBODIMENTS

The image forming apparatus, the image forming apparatus setup system, and the image forming apparatus setup method according to the present invention will now be described in detail based on preferred embodiments illustrated in the accompanying drawings.

Figure 1:
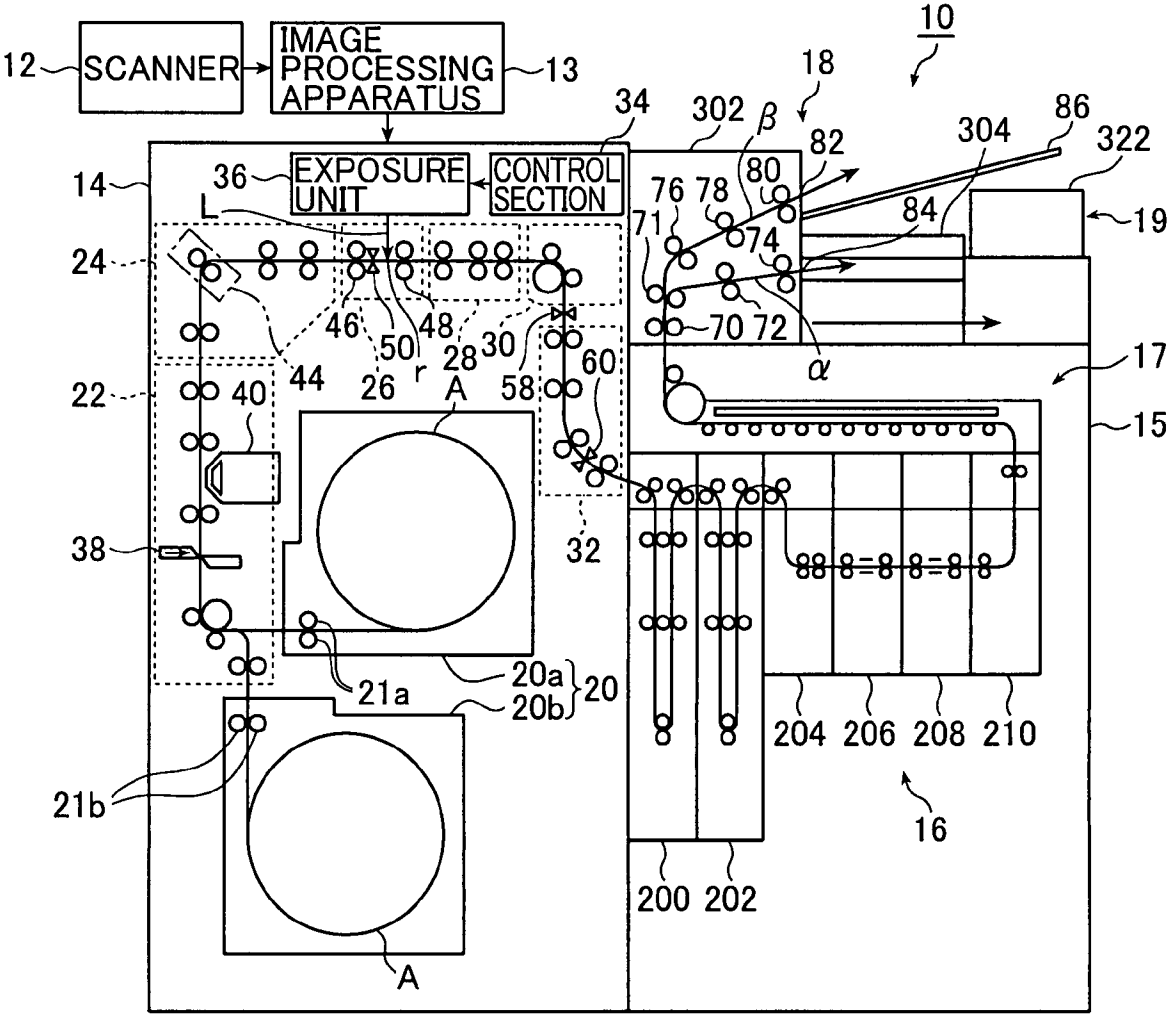
FIG. 1 is a schematic sectional view of an embodiment of an image forming apparatus according to the present invention.

FIG. 1 is a schematic sectional view of an embodiment of an image forming apparatus according to the present invention As shown in FIG. 1, an image forming apparatus 10 includes a scanner 12, an image processing apparatus 13, a printer 14, a processor 15, and a sorter 19.

The printer 14 is a recording apparatus that performs exposure-recoding on a photosensitive material through scan-exposure with a light beam. The printer 14 obtains a photosensitive material in the form of a cut sheet (hereinafter also referred to as "sheet member") by drawing out a long photosensitive material A wound in a roll form by a predetermined length and cutting it into a cut sheet shape and transports the photosensitive material to an exposure position. Then, the printer 14 deflects a light beam L modulated in accordance with image data supplied from the image processing apparatus 13 in a main scanning direction while scanning and transporting the photosensitive material in a sub scanning direction perpendicular to the main scanning direction, thereby two-dimensionally scanning and exposing the photosensitive material with the light beam L and forming an image thereon.

The printer 14 in the image forming apparatus 10 is connected to the image processing apparatus 13 and the image processing apparatus 13 is connected to the scanner 12. On the other hand, the processor 15 is connected adjacently to the printer 14 so as to receive the exposed photosensitive material discharged from the printer 14. The image forming apparatus 10 includes a control section 34 that controls the overall operation of the image forming apparatus 10. Also, in the printer 14, multiple transport roller pairs are provided which transport the sheet member (photosensitive material). With these transport roller pairs, the sheet member is transported at a preset transport speed (hereinafter also referred to as "first transport speed").

The scanner 12 captures an image taken on a film by photoelectrically reading projection light from the image with an image sensor, such as a CCD sensor, and sends data of the captured image (image data signal) to the image processing apparatus 13.

The image processing apparatus 13 performs predetermined image processing on this image data and sends resultant data to the printer 14 as image data for image recording (exposure conditions). Note that the image processing apparatus 13 may be constructed so as to send data of an image taken with a digital still camera (DSC) or the like to the printer 14.

The processor 15 performs predetermined development processing, dry processing, and the like on the exposed sheet member (photosensitive material) on which a latent image has been formed, and outputs it as a print on which an image photographed on a film or an image photographed by a DSC is reproduced. The processor 15 is provided with multiple transport roller pairs that transport the sheet member, and performs the development processing on the exposed sheet member while transporting the sheet member at a preset transport speed (hereinafter also referred to as "second transport speed") using the transport roller pairs.

The sorter 19 collects and accumulates sheet members subjected to the development processing, dry processing, and the like in units of one roll of film, for instance.

The printer 14 is constructed so as to perform each processing while transporting a sheet member obtained by cutting a long photosensitive material A wound in a roll form into a predetermined length. The printer 14 includes a supply section 20, a back print section 22, a registration section 24, an exposure section 26, an sub scanning reception section 28, a distribution unit (distributor) 30, and a delivery section 32 in the stated order from an upstream side in a transport direction of the sheet member. At each of these sites, multiple transport roller pairs consisting of rollers or drive rollers and nip rollers paired with the drive rollers are provided along a transport path. These transport roller pairs are provided at intervals shorter than the length in the transporting direction of the minimum size sheet member used in the image forming apparatus 10. Further, although not shown, in and between these portions, there are provided transporting guides, and there may be provided some other transporting means.

In the image forming apparatus 10, the distribution unit 30, a unification unit (unificator) 18, and the sorter 19 are replaceable. Note that in the image forming apparatus 10, it is possible to replace the distribution unit 30, the unification unit 18, and the sorter 19 without changing the transport speed in the printer 14 and the transport speed in the processor 15.

The supply section 20 is a site where sheet members of a photosensitive material are supplied, and is loaded with magazines 20*a* and 20*b* which are each a lightproof casing containing a long photosensitive material A wound in a roll form with its recording surface facing outward, for instance.

In ordinary cases, the photosensitive materials A contained in the magazines 20*a* and 20*b* are different kinds of photosensitive materials and are different from each other in size (width), photosensitive surface kind (silk finish or matte finish, for instance), specifications (thickness and base kind), and the like. In this embodiment, the two magazines 20*a* and 20*b* are provided, although the number of magazines used in the present invention is not specifically limited. That is, in the present invention, one magazine or three or more magazines may be used.

In the magazines 20*a* and 20*b*, drawing-out roller pairs (drawing-out unit) 21*a* and 21*b* for drawing out and transporting the photosensitive materials A contained therein are provided, respectively.

Also, a cutter 38 is provided at a position spaced apart from drawing-out openings of the magazines 20*a* and 20*b* by predetermined distances.

The drawing-out roller pairs 21*a* and 21*b* each draw out the photosensitive material A by a predetermined length in accordance with a print length and then stop this drawing-out operation and the cutter 38 cuts the drawn-out photosensitive material A. In this manner, a sheet member having a predetermined length is obtained.

The cutter 38 cuts the photosensitive material A drawn out from each magazine 20*a*/20*b* based on a control signal sent from the control section 34 of the image forming apparatus 10, with cutting intervals of the photosensitive material A by the cutter 38 being adjusted by the control section 34. The sheet member cut into the predetermined length by the cutter 38 is sent to the back print section 22. Note that the supply section 20 is not limited to the construction where the long photosensitive material A is cut into a sheet member and the sheet member is supplied. For instance, the supply section 20 may supply a sheet member formed in advance in a predetermined size. Although, in this embodiment, one cutter 38 is provided for cutting the photosensitive material A drawn out from both of magazines 20*a* and 20*b*, the cutter 38 may be arranged for each magazine.

The back print section 22 records (prints) a so-called back print giving various kinds of information, such as a photo-taking date, a print-making date, a frame number, a film ID number (code), a camera ID number, and a photoprinter ID number, on a non-recording surface (non-emulsion surface, that is, back surface) of the sheet member based on a control signal from the control section 34. The back print section 22 includes transport roller pairs for transporting the sheet member and a back print head 40.

The back print is recorded by the back print head 40 on the non-recording surface of the sheet member during upward transporting of the sheet member by rollers and roller pairs. As the back print head 40, a various print head, such as an ink-jet head, a dot impact print head, or a thermal transfer print head, is used. The back print head 40 supports the Advanced Photo System (APS) and records two or more lines of letters.

The registration section 24 curves the transporting path for the sheet members transported after having been cut into a predetermined length, from the vertical direction to the horizontal direction, and performs adjustment on the skewing or the position in the width direction of the sheet members such that the sheet members are arranged in a predetermined position in the width direction in the transporting path without being inclined with respect to the transporting path. To do so, this registration section 24 is provided with a registration roller pair 44. In addition, the registration section 24 is provided with nip roller pairs that transport the sheet member whose skewing and the position in the width direction have been adjusted by the registration roller pair 44. Here, the transporting with the nip roller pairs is performed in a shockless manner, thereby preventing skewing and misregistration of the sheet member. With this construction, at the time of subsequent exposure-recording in the exposure section 26, it becomes possible to perform scan-exposure recording at a predetermined position of the sheet member. Regarding the adjustment of the sheet members in terms of skewing and position in the width direction performed in the registration section 24, it is possible to adopt a well-known method; for example, it is possible to adopt the skew adjusting method and the width direction position adjusting method as disclosed in JP 60-153358 A and JP 11-349191 A.

As shown in FIG. 1, when passing through the registration section 24, the sheet members are changed in transporting direction from the vertical transporting to the horizontal transporting along the transporting guides (not shown) between just before and after the registration roller pair 44 previous to being transported to the exposure section 26.

The exposure section 26 includes an exposure unit 36 connected to the image processing apparatus 13, two sub scanning roller pairs 46 and 48 that are respectively provided on an upstream side and a downstream side in the transport direction from an exposure position r, at which the sheet member is scan-exposed with the light beam L emitted from the exposure unit 36, therebetween and perform sub scanning of the sheet member by transporting the sheet member at a predetermined speed, and a position detection sensor 50 that is provided between the exposure position r and the sub scanning roller pair 46 and detects passage of the sheet member. The position detection sensor 50 is a photosensor that detects the presence or absence of an object based on light blocking and is composed of a pair of light-emission element and light-reception element. The light-emission element and the light-reception element are arranged in a direction perpendicular to the transport path and the light-emission element is arranged on a non-recording-surface side of the photosensitive material A. In this embodiment, the detection target of the position detection sensor 50 is the photosensitive material A, so that a sensor (such as an infrared ray sensor of flashing type) is suited which uses light having a wavelength at which no fogging occurs.

The exposure unit 36 is, for instance, a known light beam scanning apparatus that uses a light beam such as a laser beam as recording light and includes a light source that emits a light beam L corresponding to each of red (R) exposure, green (G) exposure, and blue (B) exposure of the sheet member, modulation means (such as an acousto-optic modulator (AOM)) for modulating the light beam L emitted from the light source in accordance with post-image-processing image data supplied from the image processing apparatus 13, a light deflector (such as a polygon mirror) that deflects the modulated light beam L in a direction (main scanning direction) perpendicular to the transport direction of the sheet members, a mirror that adjusts the optical path of an fθ (scanning) lens for imaging the light beam L deflected in the main scanning direction at a predetermined position on the exposure position r with a predetermined beam diameter, and the like.

Alternatively, the exposure unit 36 may be digital exposure means that uses a light-emission array, a spatial modulation element array, or the like that is provided so as to extend in the main scanning direction perpendicular to the transport direction. Examples of the light-emission array and the spatial modulation element array are a plasma display (PDP) array, an electro luminescent display (ELD) array, a light-emitting diode (LED) array, a liquid crystal display (LCD) array, a digital micromirror device (DMD) (registered trademark) array, and a laser array.

The width of the main scanning performed by the exposure unit 36 using the light beam L at the exposure position r is set so as to correspond with the width of the sheet members. The operation of the exposure unit 36 described above is controlled by a control signal from the control section 34.

The light beam L that is recording light is deflected in the main scanning direction (direction perpendicular to the paper plane of FIG. 1) and the sheet member is transported by the two sub scanning roller pairs 46 and 48, so that the sheet member is two-dimensionally scan-exposed by the light beam L modulated in accordance with the image data and an image is recorded thereon.

Instead of the sub scanning roller pairs 46 and 48, a scan-transport mechanism may be used which uses an exposure drum that transports the sheet member while holding it at the exposure position r and two nip rollers that abut against the exposure drum with the exposure position r in-between. The construction of the scan-transport mechanism is not specifically limited so long as an image is recorded on a transported sheet member by performing scan-recording in the main scanning direction perpendicular to the transport direction of the sheet member.

The sub scanning reception section 28 is a site where multiple roller pairs (three roller pairs, in this embodiment) are provided which support the leading end portion of the sheet member subjected to the recording in the exposure section 26 and protruding from the exposure section 26. Each roller pair is composed of a drive roller and a nip roller that is movable with respect to the drive roller and is capable of effecting a nip canceling. Transporting of the sheet member by these roller pairs is performed at a speed that is the same as the transport speed of the sub scanning roller pairs.

As will be described later, during exposure-recording, the nip rollers are controlled so that they are spaced apart from their corresponding drive rollers and do not nip the sheet member. On the other hand, when exposure-recording in the trailing end portion of the sheet member is ended, the nip rollers are controlled so as to contact their corresponding drive rollers for nipping and transport the sheet member. The reason why this construction is adopted is that if the nip rollers abut against the sheet member and start nipping during exposure-recording on the sheet member, minute vibrations occur and therefore misregistration of the exposure position of the sheet member and exposure unevenness occur. As a matter of course, the operation of the sub scanning reception section 28 is controlled by a control signal supplied from the control section 34.

The distribution unit 30 is a site where sheet members transported in a single line are distributed into plural lines (two lines, in this embodiment) in the main scanning direction in accordance with the sizes of the sheet members without stopping the transporting of the sheet members at the predetermined first transport speed. This distribution unit 30 is replaceable and is capable of adjusting its distribution speed at which the sheet members are distributed in the main scanning direction. The distribution unit 30 is replaced in the form of a distribution unit having a distribution mechanism. The printer 14 includes a first mount portion, to which the distribution unit 30 is mountable, and the distribution unit 30 is demountably mounted to this first mount portion.

This distribution unit 30 will be described in detail later.

Provided between the distribution unit 30 and the delivery section 32 is a position detection sensor 58.

This position detection sensor 58 is a sensor that detects the leading end of each sheet member having passed through the distribution unit 30 immediately after the passage and the details thereof will be described later. Note that as the position detection sensor 58, it is possible to use a sensor having the same construction as the position detection sensor 50.

Also, in the printer 14, the distribution unit 30 is provided at a corner portion in the transport path so that the transport direction of the sheet members is changed from the horizontal direction to a downward direction (out-of-plane direction of the recording surfaces of the sheet members) during the distribution of the sheet members. With this construction, it becomes possible to give the sheet members a curvature in the out-of-plane direction of the recording surfaces of the sheet members, which makes it possible to prevent paper jams and to smoothly perform the distribution by reducing the stiffness of the sheet members.

Next, with reference to FIGS. 2 through 7, the distribution mean which is applied to the image forming apparatus of the present invention will be described in detail.

Figure 2:
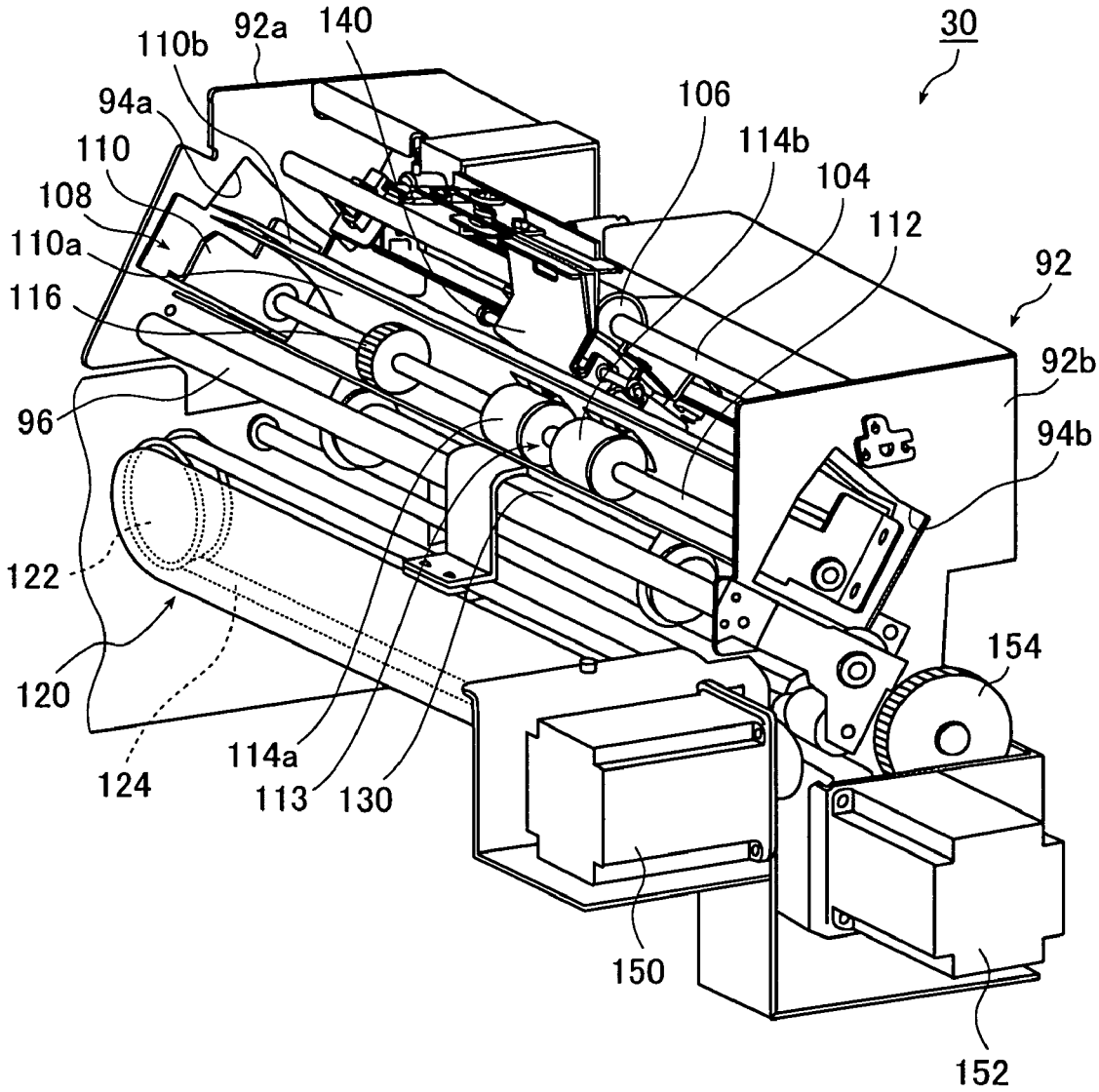
FIG. 2 is a perspective view schematically showing an embodiment of a distribution unit which is applied to the image forming apparatus shown in FIG. 1.

FIG. 2 is a perspective view of the distribution unit (distributor) 30 which is applied to the image forming apparatus shown in FIG. 1.

The distribution unit 30 has a moving member 108 for distributing sheet members, a driving portion (driving means) 120 for moving the moving member to the right and left, and a nip canceling mechanism (nip canceling means) 140.

In the distribution unit 30, the moving member 108 and the driving portion 120 are provided as separate components on a frame member 92 with side plates 92*a* and 92*b* having window portions 94*a* and 94*b*.

A support shaft 96 is fixed to the side plates 92*a* and 92*b*, and, further, fixed thereto is a guide shaft 104*a* that is passed through a slide bearing 106 provided in the nip canceling mechanism 140 described below.

As described below, the moving member 108 is equipped with a transporting roller pair 113. The transporting roller pair 113 has large diameter transporting rollers 114*a* and 114*b* and two sets of small diameter nip rollers 115*a*, 115*b* and 117*a*, 117*b* (see FIGS. 6 and 7) respectively abutting the large diameter transporting rollers 114*a* and 114*b* and adapted to distribute photosensitive materials by nipping therebetween and transporting them.

Further, the moving member 108 has a seamless pipe slide (hereinafter also referred to as the pipe slide) 130 which is a rotary moving mechanism for moving the transporting rollers 114*a* and 114*b* to the right and left in a rotating state, and the nip canceling mechanism 140 for controlling the nipping and releasing of the nip rollers 115*a*, 115*b*, 117*a*, and 117*b* provided for the transporting rollers 114*a* and 114*b*.

The moving member 108 has a long casing 110 provided at a position matched with the window portions 94*a* and 94*b* of the side plates 92*a* and 92*b*, and the casing 110 is equipped with a pair of guide plates 110*a* and 110*b* having slits through which sheet members are passed.

Further, in the longitudinal direction thereof, the casing 110 is equipped with a support shaft 112 to which the transporting rollers 114*a* and 114*b* and a gear 116 are mounted. This support shaft 112 is parallel to the guide shaft 104.

Further, the driving portion 120 serves to move the moving member 108 in the main scanning direction (hereinafter also referred to as the distributing direction), and it does not move in the distributing direction together with the moving member 108. The driving portion 120 has a pair of pulleys 122 and an endless belt 124 wrapped around these pulleys 122. The pulleys 122 are connected to the casing through a rotation transmitting mechanism composed of a gear and a rotation shaft. Through the rotation of the pulleys 122, the moving member 108 moves in the distributing direction parallel to the guide shaft 104, that is, in the main scanning direction.

Further, a motor 150 is connected to the other pulley (not shown). By rotating the motor 150 in the normal or reverse direction, it is possible to move the moving member 108 in the main scanning direction. The motor 150 is also connected to the control section 34 (see FIG. 1), and its rotation is controlled by the control section 34.

Figure 3:
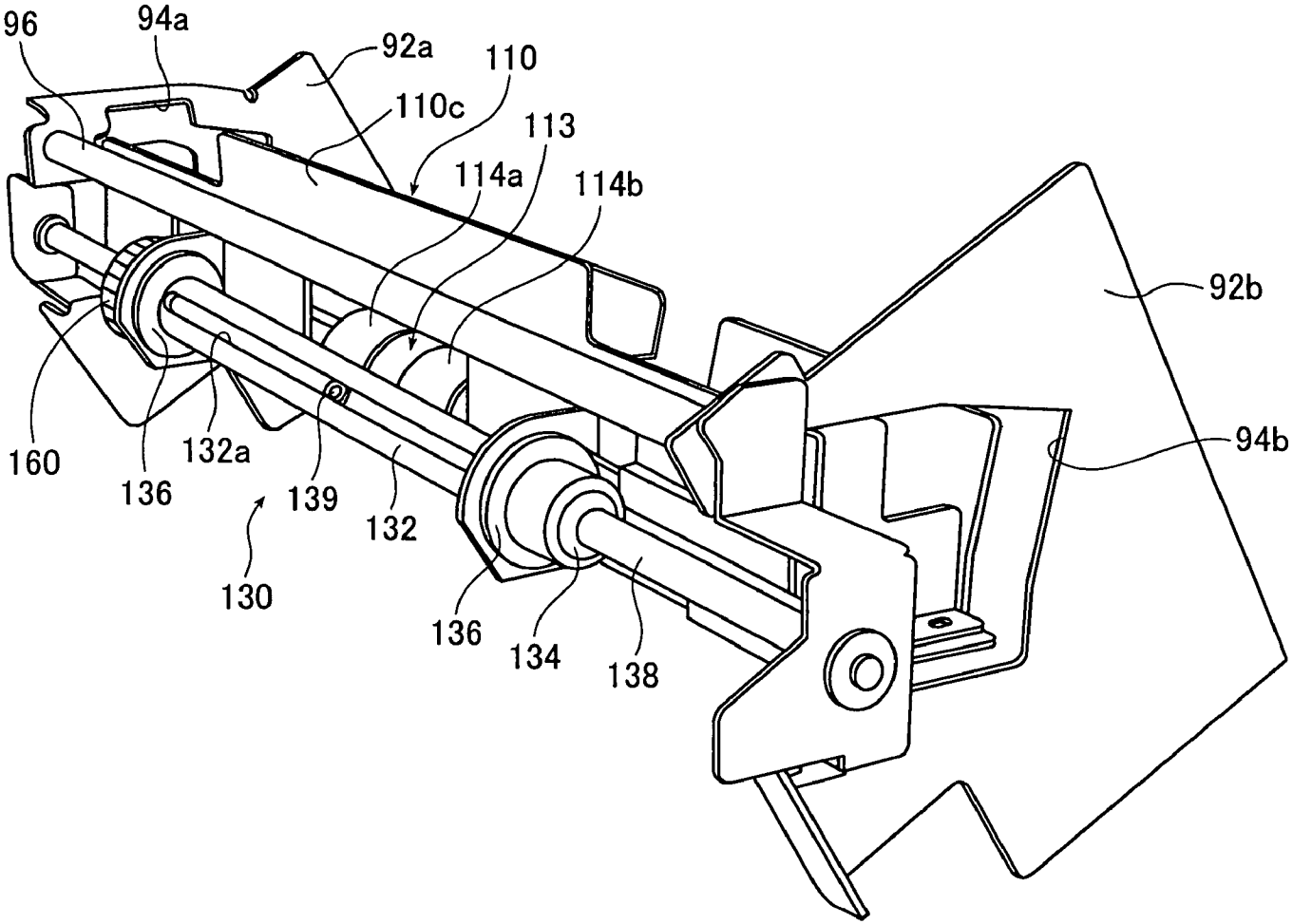
FIG. 3 is a perspective view schematically showing the arrangement and construction of a moving member in the distribution unit shown in FIG. 2.

FIG. 3 is a perspective view schematically showing the arrangement and construction of the moving member in the distribution unit of this embodiment. In FIG. 3, the components that are the same as those shown in FIG. 2 are indicated by the same reference numerals, and a detailed description of such components will be omitted.

As shown in FIG. 2, provided on a lower surface 110*c* (see FIG. 4) of the casing 110 is the pipe slide 130 as described below. Due to the pipe slide 130, the casing 110 can protrude from the window portions 94*a* and 94*b* through distribution at the time of distribution. In the following, the construction of the pipe slide 130 will be described in detail with reference to FIG. 4.

Figure 4:
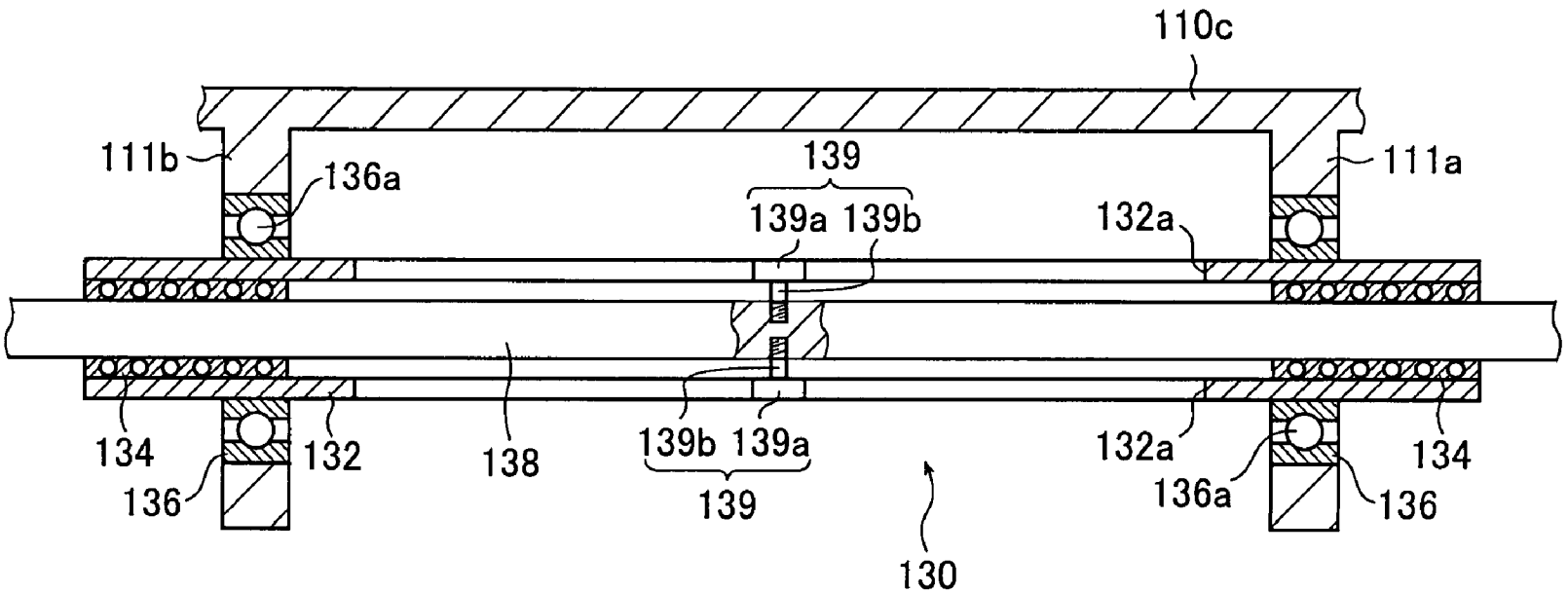
FIG. 4 is a sectional view schematically showing the construction of a seamless pipe slide of the moving member shown in FIG. 3.
Figure 5:
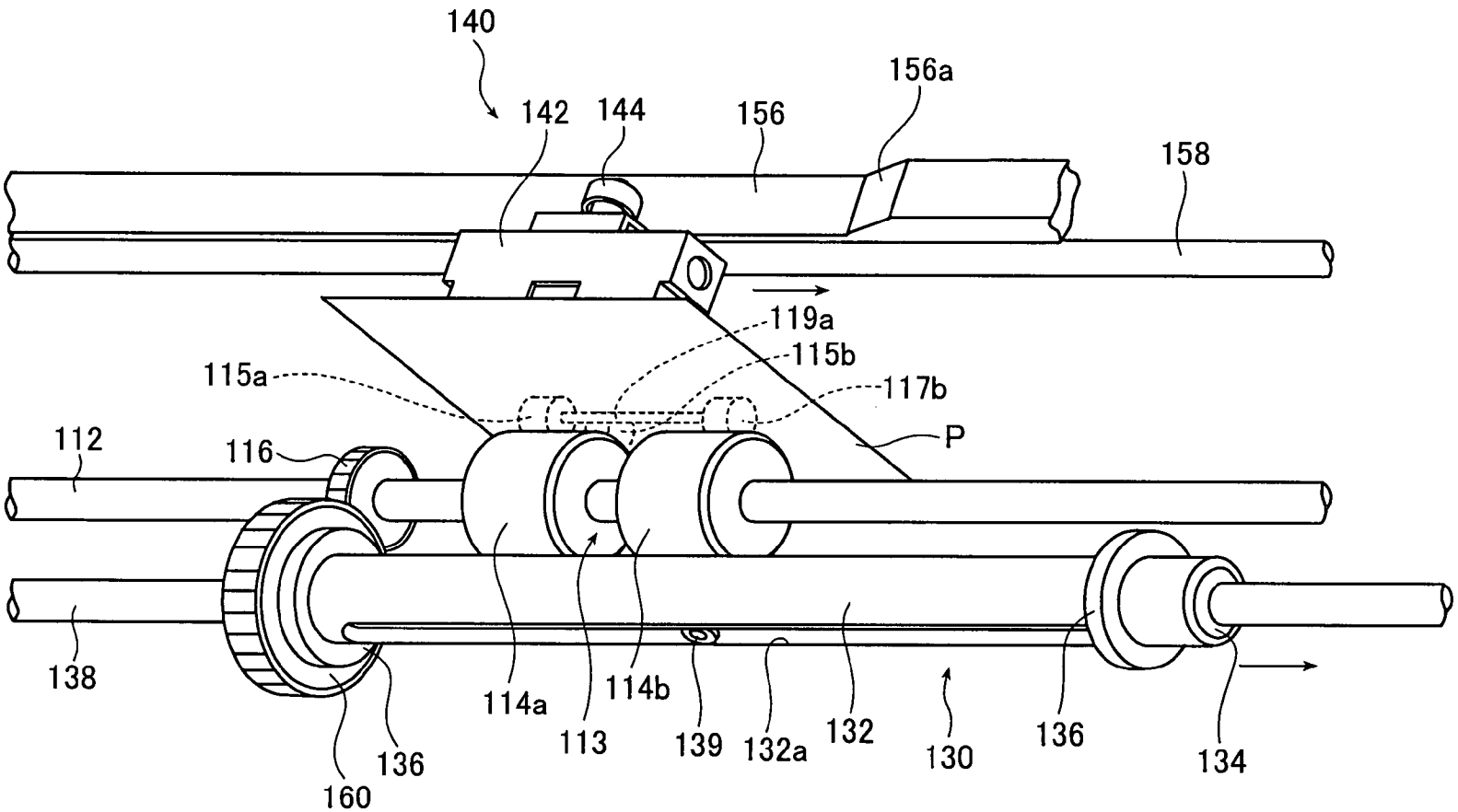
FIG. 5 is a partly exploded perspective view showing how the seamless pipe slide and a nip canceling mechanism in the moving member of the distribution unit shown in FIG. 4 are arranged.

FIG. 4 is a sectional view schematically showing the construction of the seamless pipe slide of the moving member in this embodiment shown in FIG. 3. As shown in FIG. 5, the pipe slide 130 is provided on flanges 111*a* and 111*b* erected on the lower surface 110*c* of the casing 110 of the moving member 108, for example through a pair of ball bearings 136.

The pipe slide 130 has a sleeve 132, at least one pair of slide bearings 134, and a rotation shaft 138.

The sleeve 132 has a cylindrical shape, and has on the outer peripheral surface thereof a pair of opposing elongated holes 132*a* extending in the longitudinal direction (axial direction). The sleeve 132 is provided on the flanges 111*a* and 111*b*, for example through a pair of ball bearings 136*a*. Further, the sleeve 132 is equipped, for example, with the pair of slide bearings 134 on the inner peripheral surfaces in both the end portions.

A rotation shaft 138 is formed in the slide bearings 134. The rotation shaft 138 is fixed to the side plates 92*a* and 92*b*, and rotation transmitting members 139 are provided at positions in alignment with the elongated holes 132*a* of the sleeve 132. The rotation transmitting members 139 include bearings 139*a* and shaft portions 139*b* provided at the centers of the bearings 139*a*. An end of each shaft portion 139*b* is threaded.

When the rotation shaft 138 moves relative to the sleeve 132, the rotation transmitting members 139 move longitudinally inside the elongated holes 132*a* and abut the ends of the elongated holes 132*a* to regulate the rotation shaft 138, thus serving as anti-detachment members. Further, when the support shaft rotates, the rotation transmitting members 139 press the elongated holes 132*a* to thereby transmit the rotation of the rotation shaft 138 to the sleeve 132. The sleeve 132 is supported by the ball bearings 136, so that the sleeve 132 also rotates, whereby the rotation of the rotation shaft 138 is transmitted to the sleeve 132.

Further, the rotation shaft 138 has at its end a gear 154, to which a motor 152 is connected. The motor 152 is also connected to the control section 34, by means of which the rotation of the motor 152 is controlled, thereby controlling the rotation of the transporting rollers 114*a* and 114*b*.

FIG. 5 is a partly exploded perspective view showing how the seamless pipe slide 130 and the nip canceling mechanism 140 in the moving member 108 of this embodiment are arranged.

As shown in FIG. 5, a gear 160 is provided on the sleeve 132 of the pipe slide 130. The gear 160 is connected with a gear 116, whereby the rotation of the rotation shaft 138 is transmitted to the support shaft 112 through the gears 160 and 116, and the transporting rollers 114*a* and 114*b* rotates.

On the other hand, there is provided in the upper portion of the casing a nip canceling mechanism 140 for controlling the nipping and releasing of the nip rollers 115*a*, 115*b*, 117*a*, and 117*b* provided for the transporting rollers 114*a* and 114*b*.

Figure 6:
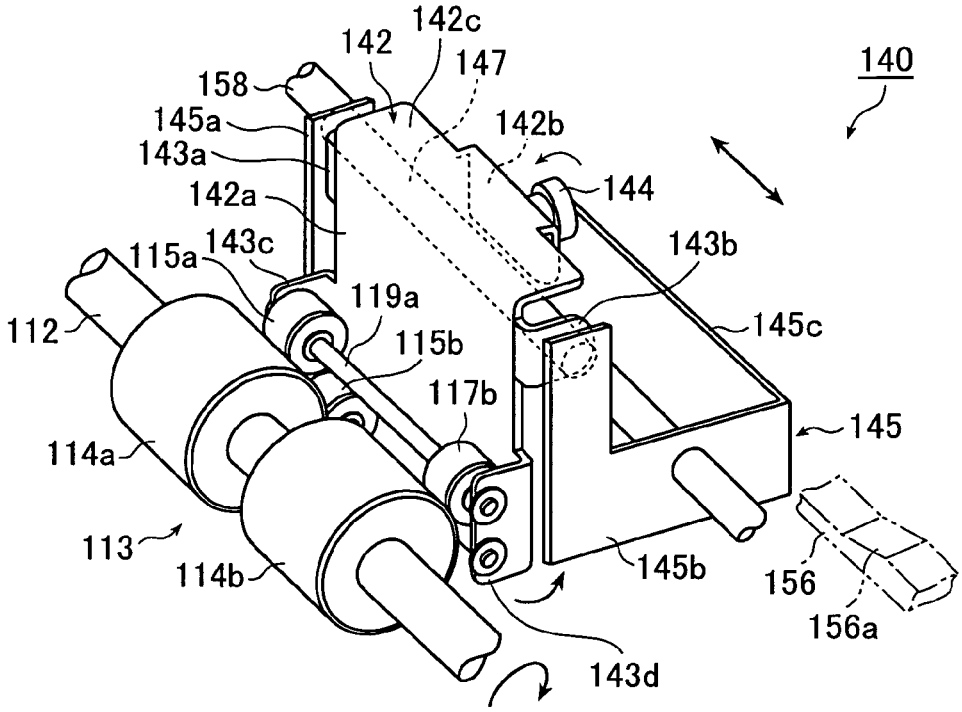
FIG. 6 is a perspective view schematically showing the construction of the nip canceling mechanism in the distribution unit shown in FIG. 2.
Figure 7:
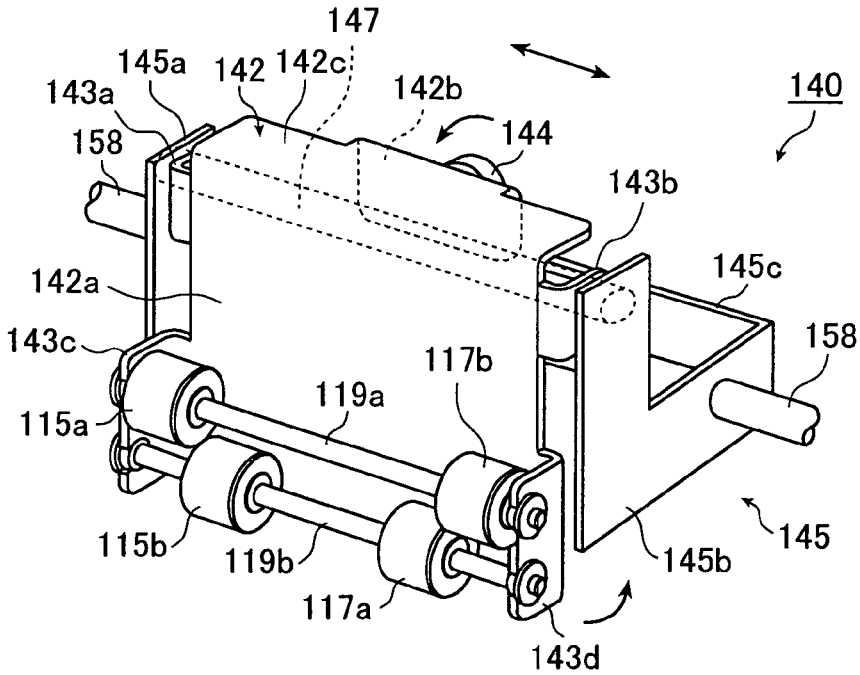
FIG. 7 is a partial perspective view showing the nip canceling mechanism (except large diameter transport rollers) shown in FIG. 6.

FIG. 6 is a perspective view schematically showing the construction of the nip canceling mechanism in the distribution unit of the embodiment shown in FIG. 2, and FIG. 7 is a partial perspective view of the nip canceling mechanism (except large diameter transporting rollers 114*a* and 114*b* and the support shaft 112) shown in FIG. 6.

The nip canceling mechanism 140 has a canceling member 142 and a fixing member 145 which rotatably supports the canceling member 142 and is fixed to the moving member 108. The canceling member 142 and the fixing member 145 rotatably support the small diameter nip rollers 115*a*, 115*b*, 117*a* and 117*b* and pivotally supports these nip rollers 115*a*, 115*b*, 117*a* and 117*b* so that they can be brought into contact with or moved away from the large diameter transporting rollers 114*a* and 114*b*.

The canceling member 142 includes a rectangular base member 142*a*, one end portion of which is bent into a hook-like shape, and a driven member 144 is provided on a bent portion 142*b* located at a tip end thereof.

Below the driven member 144, there is provided a guide member 156. This guide member 156 is a long slender plate member extending in a direction parallel to the direction in which the moving member 108 is moved, and a slope 156*a* is provided at an end thereof. The slope 156*a* is provided at a position spaced apart by a distance larger than the distributing width. The driven member 144 and the guide member 156 form a translation cam mechanism. In the nip canceling mechanism 140, nipping by the nip rollers is controlled by this translation cam mechanism. As described below, in ordinary distribution, no nip canceling is effected.

Further, below an upper portion 142*c* which is perpendicular to the base member 142*a* and which is formed by bending one end thereof into a hook-like shape, the canceling member 142 has support members 143*a* and 143*b* which extend from the long sides of the base member 142*a* so as to be opposed to each other on the side where the driven member 144 is provided. In these support members 143*a* and 143*b*, a pivot shaft 147 is provided pivotally with respect to the fixing member 145. The canceling member 142 is thus pivotally connected to the fixing member 145 through this pivot shaft 147.

Further, shaft support members 143*c* and 143*d* extend from the long sides of the base member 142*a* at the end opposite to the upper surface 142*c* toward the side opposite to the side where the driven member 144 is provided and are opposed to each other. The shaft support members 143*c* and 143*d* rotatably support the rotation shaft 119*a* of the nip rollers 115*a* and 117*b* and the rotation shaft 119*b* of the nip rollers 115*b* and 117*a* such that they extend in parallel in the longitudinal direction of the base member 142*a*.

The fixing member 145 includes a pair of L-shaped side surface members 145*a* and 145*b* and a rectangular connecting member 145*c* connecting one end of the side surface member 145*a* and one end of the side surface member 145*b* to each other. In the fixing member 145, the other ends of the side surface members 145*a* and 145*b* are free, and the length of the connecting member 145*c* is larger than the short side length of the base member 142*a*. The other ends of the fixing member 145 are connected to the canceling member 142 through the pivot shaft 147, whereby there is no fear of the canceling member 142 coming into contact with the fixing member 145. In other words, in the upper portions of the side surface members 145*a* and 145*b*, the fixing member 145 pivotally supports the pivot shaft 147 passing through the members 143*a* and 143*b* of the canceling member 142. In the present invention however, the pivot shaft 147 may be attached to the side surface members 145*a* and 145*b* in a fixed manner so that the members 143*a* and 143*b* of the canceling member 142 can be pivoted on the pivot shaft 147.

Further, a guide shaft 158 is passed through the side surface members 145*a* and 145*b* of the fixing member 145 so as to be parallel to the long side of the connecting member 145*c*. This guide shaft 158 is a shaft parallel to the support shaft 112, and is fixed to the side plates 92*a* and 92*b*. Between the side surface members 145*a* and 145*b* and the guide shaft 158, there are provided slide bearings (not shown).

In the nip canceling mechanism 140, the moving member 108 is moved in the main scanning direction, and, when the driven member 144 climbs the slope 156*a* of the guide member 156, the canceling member 142 pivots on the pivot shaft 147 toward the guide shaft 158 side, and the nip rollers 115*a*, 115*b*, 117*a*, and 117*b* are spaced apart from the transporting rollers 114*a* and 114*b*, whereby the sheet members being transported are transported as they are without being distributed.

While in this embodiment a translation cam mechanism is used as the nip canceling mechanism 140, this should not be construed restrictively. That is, it is also possible to construct the canceling mechanism 140 using a sorter or a solenoid. Instead of using the guide member 156, it is also possible to form in a plate member a guide groove of a sectional configuration similar to that of the guide member 156. A driven member equipped with a bar-like guide member is inserted into that guide groove; when the canceling member 142 moves, the position of the guide bar is changed to thereby cancel the nipping.

Further, it is also possible to provide, at a position that is the same as the position where the slope 156*a* is provided, a wedge member to be inserted between the transporting rollers and the nip rollers, whereby the nip rollers are separated from the transporting rollers by moving the moving member by a predetermined distance. Thus, as in the case of the translation cam mechanism, it is possible to cancel the nipping.

Further, while in the above construction the guide member 156 is equipped with one slope 156*a*, this embodiment is not restricted to this arrangement. It is also possible to provide slopes at both ends of the guide member 156. In this case, since there is a slope at either end of the guide member, the guide member is moved to the nearer slope whenever nipping is to be canceled, whereby the requisite time for nip canceling can be shortened.

In this embodiment, the distribution unit 30 is provided at a position spaced apart from the exposure section 26 by a distance larger than the maximum length in the transporting direction of the sheet members used. That is, the distribution unit 30 and the exposure section 26 are spaced apart from each other by a distance larger than the maximum length in the transporting direction of the sheet members of a size requiring no distribution. Thus, the exposure is not affected even if the distribution is effected while nipping the sheet members by the nip rollers 115*a*, 115*b*, 117*a*, and 117*b*.

When no distribution is to be effected, the moving member 108 is moved to the slope 156*a* side to separate the nip rollers 115*a*, 115*b*, 117*a*, and 117*b* from the transporting rollers 114*a* and 114*b* to effect nip canceling, and then sheet members are allowed to pass as they are. In this embodiment, sheet members of a small size are distributed but sheet members of a large size are not distributed, so that even the length in the transporting direction of the maximum size sheet members to be distributed is smaller than the length in the transporting direction of the longest sheet members not to be distributed. Thus, it goes without saying that exposure is not affected even when no distribution is to be effected.

In the distribution unit 30 in this embodiment, the pipe slide 130 is used, so that when distribution is performed, it is possible to distribute the sheet members in the main scanning direction while performing sheet transporting in the sub scanning transport direction without stopping the sheet transporting. As a result, it becomes possible to increase the number of sheet members processed per unit time and to achieve a superior distribution processing capacity. Also, in the distribution unit 30, drive means, such as a motor, is not provided for the moving member, so that it becomes possible to reduce the mass thereof and to increase the distribution speed without causing loss of synchronism. As a result, it becomes possible to perform the distribution at high speed. Further, the distribution unit 30 is supported through bearings in each of the main scanning direction and the rotation direction, so that the frictional resistance is reduced and superior durability is achieved. That is, the moving body is capable of performing smooth movement at high speed while maintaining high durability.

As described above, the distribution unit 30 in this embodiment shown in FIGS. 2 to 7 has a high sheet distribution processing capacity. That is, the number of sheet members P that the distribution unit 30 is capable of distributing into two lines per unit time is large. In addition, the durability is extremely high and the resistance is small, so that it is also possible to increase the distribution speed of the distribution unit 30. Here, the distribution speed of the distribution unit 30 is controlled by the control section 34.

In this embodiment, it is possible to select the distribution unit in accordance with a required sheet output amount per unit time (required number of sheet members to be printed per unit time) of the image forming apparatus 10 without changing the transport speed of the printer 14. For instance, it is also possible to use another distribution unit described below. Next, the other distribution unit in this embodiment will be described.

Figure 8:
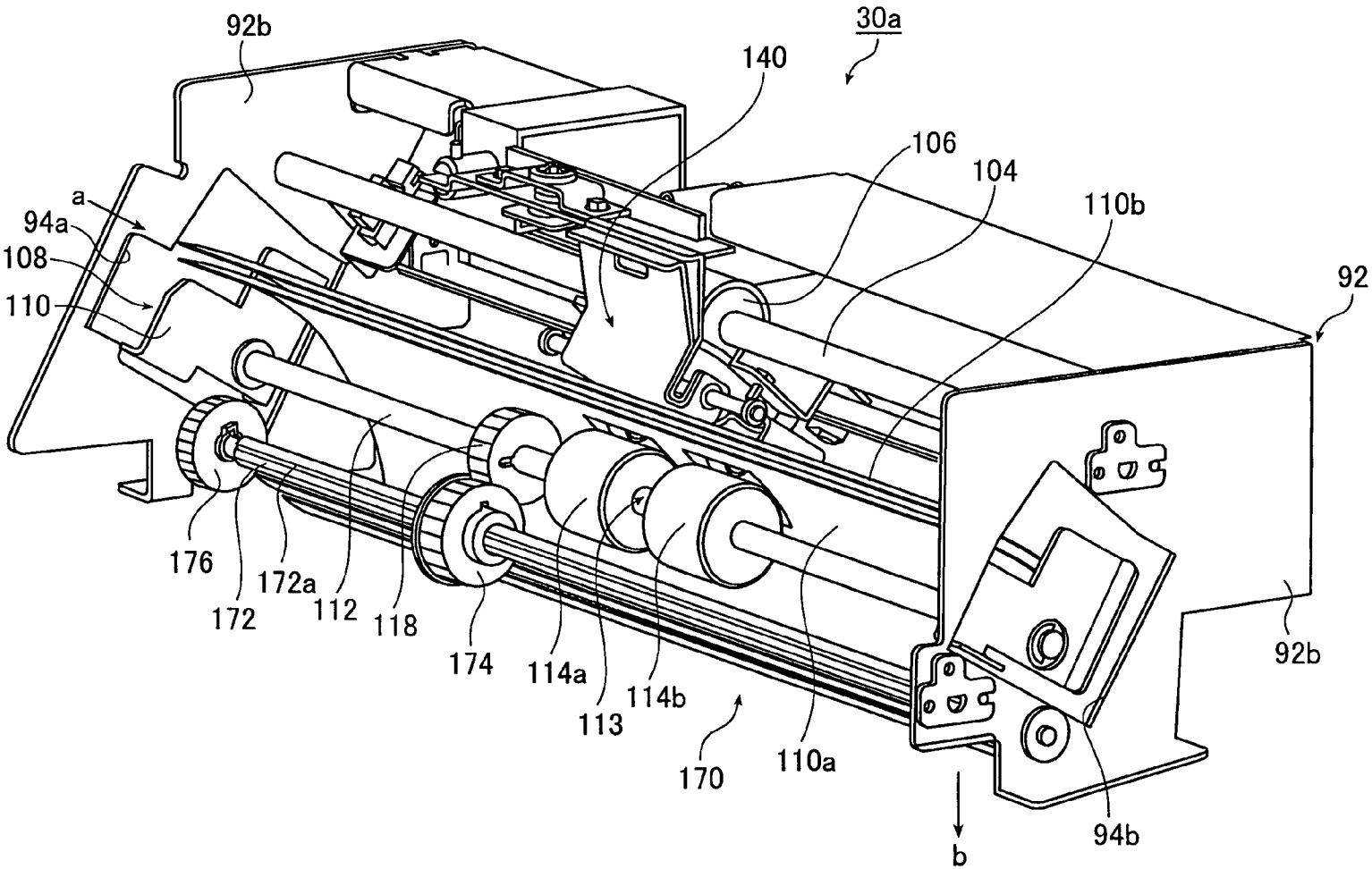
FIG. 8 is a perspective view schematically showing another embodiment of the distribution unit which is applied to the image forming apparatus shown in FIG. 1.
Figure 9:
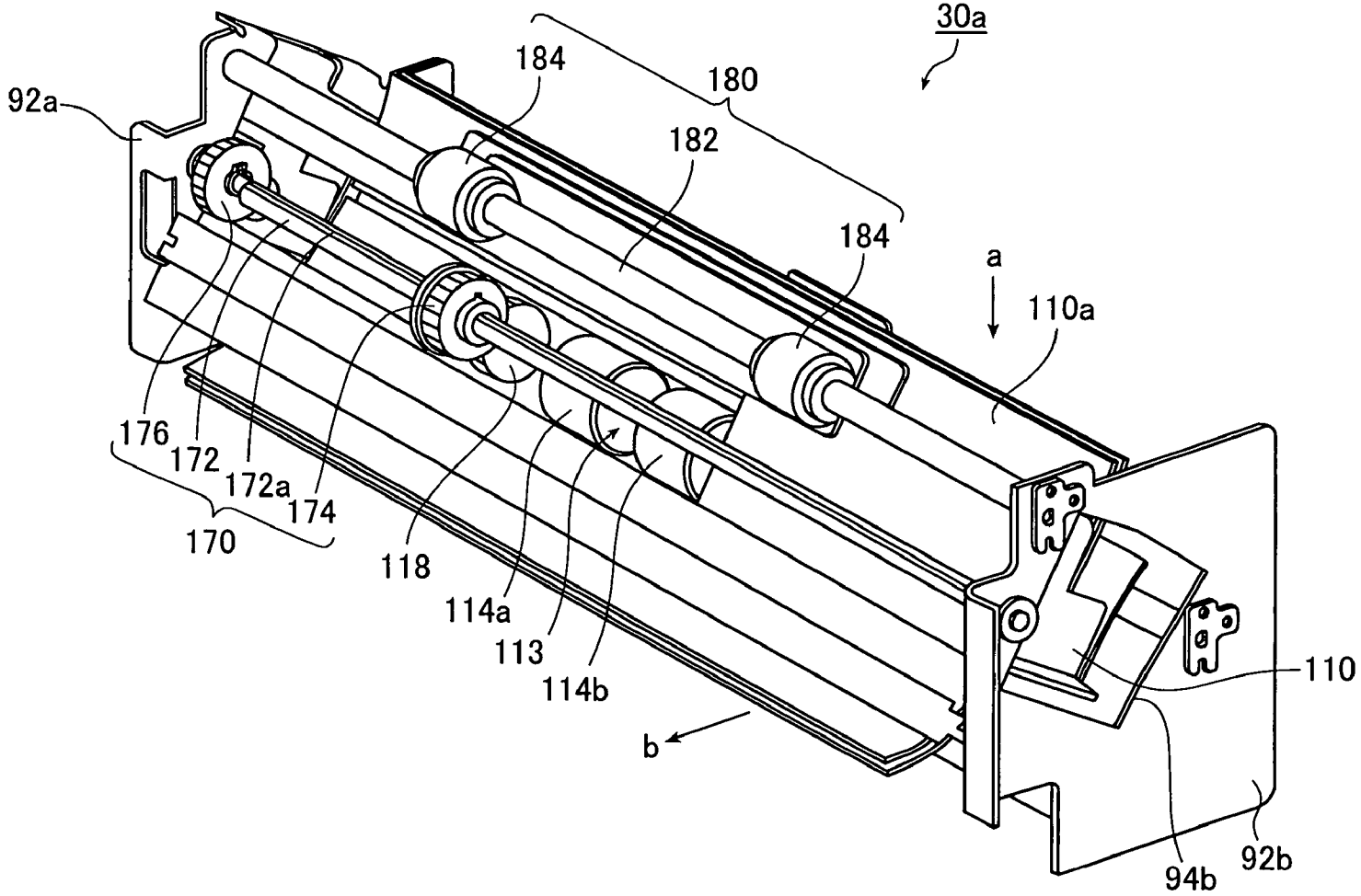
FIG. 9 is a schematic perspective view of the distribution unit shown in FIG. 8 as seen from the sheet member discharge side.

FIG. 8 is a schematic perspective view showing the other distribution unit of the image forming apparatus in the embodiment of the present invention. In FIG. 8, the arrow "a" indicates a sheet introduction direction and the arrow "b" indicates a sheet discharge direction. FIG. 9 is a perspective view where the other distribution unit in this embodiment is viewed from a discharge direction side. In FIG. 8, the illustration of a slide mechanism shown in FIG. 9 is omitted.

As shown in FIG. 8, a distribution unit 30*a* differs from the distribution unit 30 described above in that the driving mechanism for the moving member 108 does not have the pipe slide 130 but a spline mechanism 170 and a slide mechanism 180; otherwise, it is of the same construction as the distribution unit 30 described above, so that a detained description thereof will be omitted.

In the distribution unit 30*a* of this embodiment, the spline mechanism 170 has a spline shaft 172, a gear (rotation transmitting member) 174 slidably provided on the spline shaft 172, and a driving gear 176 provided at an end of the spline shaft 172.

The spline shaft 172 is fixed to the side plates 92*a* and 92*b*, and the spline shaft 172 has in the outer peripheral surface thereof a spline groove 172*a* extending in the axial direction.

The gear 174 has a fitting portion (not shown) to be fitted into the spline groove 172*a* of the spline shaft 172, and this fitting portion can move in the axial direction of the spline shaft 172. Transmitted to this gear 174 is the rotation of the spline shaft 172 by means of the fitting portion. Further, the gear 174 is engaged with a gear 118 rotating the support shaft 112 of the transporting rollers 114*a* and 114*b*. Further, the spline shaft 172 is equipped with a driving gear 176, which is meshed with a transmission gear (not shown). The spline shaft 172 is rotated by the transmission gear. Since the gear 174 is provided on the spline shaft 172, it follows the movement of the moving member 108 in the main scanning direction (distributing direction), making it possible to transmit rotation to the transporting rollers 114*a* and 114*b* while moving in the axial direction of the spline shaft 172.

Further, as shown in FIG. 9, the slide mechanism 180 is provided between the side plates 92*a* and 92*b*, and has a guide shaft 182 fixed to the side plates 92*a* and 92*b* and a guide member 184 provided so as to be movable in the longitudinal direction with respect to the guide shaft 182. The guide member 184 is connected to the moving member 108, and the guide member 184 moves on the guide member 182 with the movement of the moving member 108. Due to this slide mechanism 180, the movement of the moving member 108 in the main scanning direction is effected smoothly.

As the guide member 184, it is possible to use, for example, a slide bearing; in this embodiment, a pair of slide bearings are provided. However, the guide member 184 is not restricted to that of this embodiment; any type of member will serve the purpose as long as it is capable of reciprocating in the longitudinal direction while being guided by the guide shaft 182; further, there are no particular limitations regarding the size and number of such guide members as long as they allow connection to the moving member 108 and are capable of moving while supporting the moving member 108. For example, instead of the pair of guide members 184 shown, it is also possible to provide a single guide member having a large longitudinal size, or not less than a pair of, that is, not less than two guide members.

Further, it is not always necessary to provide this slide mechanism 180; it is not absolutely necessary if the spline shaft 172 has sufficient strength.

Also in the distribution unit 30*a* of this embodiment, no driving means, such as a motor, is provided on the moving member 108, so that it is possible to achieve a reduction in weight, whereby it is possible to obtain the same effect as that of the distribution unit 30 described above.

It should be noted here that the distribution unit 30*a* uses the spline shaft, so that its durability is inferior as compared with the distribution unit 30 described above. However, it is possible to produce this distribution unit 30*a* at low cost, so that when such high durability as that of the distribution unit 30 is not required, it is preferable that the distribution unit 30*a* is used. The distribution unit 30*a* is suited for a middle distribution speed to a high distribution speed (middle-speed operation to high-speed operation) and its distribution speed is adjusted by the control section 34 in accordance with the output amount of the image forming apparatus 10.

The operation of the distribution unit 30*a* is the same as that of the distribution unit 30 described above, so that the detailed description thereof will be omitted. In the distribution unit 30*a* also, the driving roller is constantly rotating, and, in this state, the moving member 108 is moved in the distributing direction (main scanning direction), thereby distributing sheet members into, for example, two lines. Further, when the sheet members are of a size requiring no distribution, the moving member is retracted, thereby effect nip canceling, allowing the sheet members to pass as they are. Further, the operation of the distribution unit 30*a* is the same as that of the distribution unit 30 described above, so that it is possible to produce the same effect as in the case of the distribution unit 30.

As described above, in this embodiment, the distribution unit is replaceable without changing the transport speed in the printer 14, so that it becomes possible to select a proper distribution unit as appropriate in accordance with required performance such as durability or cost.

Figure 10:
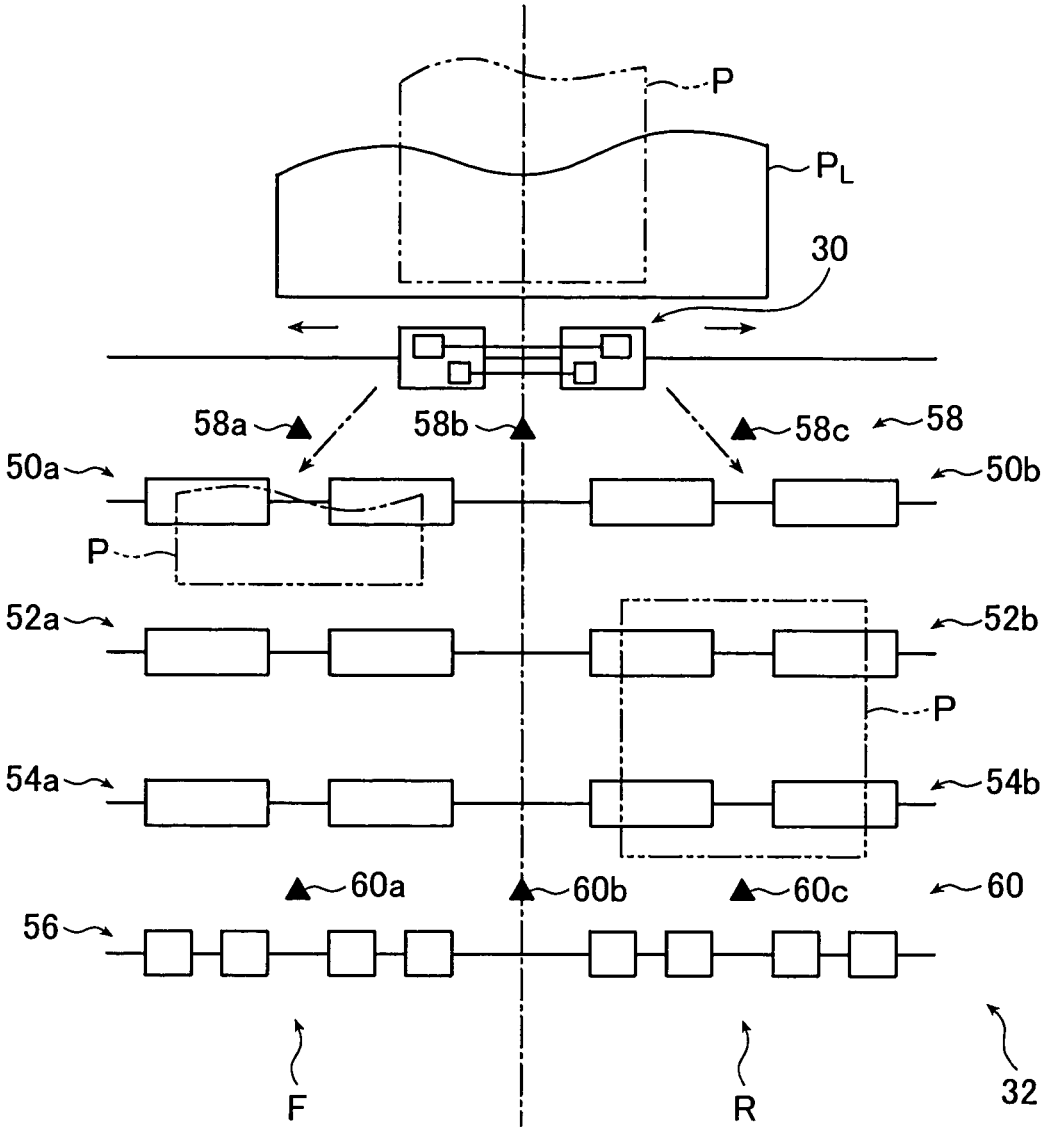
FIG. 10 is a schematic plan view of a delivery section of the image forming apparatus shown in FIG. 1 when it is seen from the above.

Referring again to FIG. 1, the delivery section 32 serves to transport the sheet members distributed into two lines by the distribution unit 30 independently for each line. In FIG. 1, the delivery section 32 is illustrated as having a single path. Actually, however, the rollers in the transporting paths F and R are arranged with their axes aligned with each other about each axis arrayed in the transport direction as shown in FIG. 10. FIG. 10 is a schematic plan view of the transporting paths F and R of the delivery section 32 as seen from the above.

As shown in FIG. 10, position detection sensors 58*a* to 58*c* (collectively referred to as the position detection sensor 58 in the above description) are provided between the distribution unit 30 and the transport section 32.

In the transport path F, nip roller pairs 50*a* and 52*a* and a speed governor roller pair 54*a* are provided from the upstream side in the transport direction. In a like manner, in the transport path R, nip roller pairs 50*b* and 52*b* and a speed governor roller pair 54*b* are provided. In addition, discharge roller pairs 56 are provided across the transport paths F and R. The transport path F and the transport path R are controlled independently of each other and transport the sheet members independently of each other.

Provided between the speed governor roller pairs 54*a* and 54*b* and the discharge roller pairs 56 are position detection sensors 60*a* to 60*c*.

The position detection sensors 60*a* to 60*c* are sensors that detect the sheet members.

The nip roller pairs 50*a* and 52*a* and the nip roller pairs 50*b* and 52*b* are each controlled in nipping/nip canceling by the control section 34.

The discharge roller pairs 56 are roller pairs that introduce the sheet members, whose transport speed has been adjusted, into the processor 15 at a predetermined transport speed.

As the position detection sensors 60*a* to 60*c*, it is possible to use sensors having the same construction as the position detection sensor 50. The position detection sensors 60*a* to 60*c* are also sensors that detect the positions of the sheet members.

As shown in FIG. 10, in the delivery section 32, the sheet members P distributed into two lines are transported in the respective transport paths F and R by the nip roller pairs 50*a* and 52*a* and the nip roller pairs 50*b* and 52*b* independently of each other. Also, in the case of sheet members $P_L$ having a size with which distribution is not performed and single-line transporting is performed, such sheet members are transported across the transport path F and the transport path R.

In the delivery section 32, when the leading end positions of the sheet members P are detected by the position detection sensors 60*a* to 60*c*, the transport speed is reduced by the speed governor roller pairs 54*a* and 54*b*. That is, in the image forming apparatus 10, in the transport path from the back print section 22 through the registration section 24, the exposure section 26, the sub scanning reception section 28, and the distribution unit 30 to the nip roller pairs 50*a* and 52*a* and the nip roller pairs 50*b* and 52*b* in the delivery section 32, the sheet members P are transported at a constant speed, for example, of 100 (mm/sec) and the transport speed of the sheet members P is reduced by the speed governor roller pairs 54*a* and 54*b* from 100 (mm/sec) to 45.3 (mm/sec) or the like. When doing so, immediately before the speed reduction by the speed governor roller pairs 54*a* and 54*b* is started, the nip roller pairs 50*a* to 52*b* are controlled so that nip rollers are spaced apart from drive rollers to effect nip canceling. This speed reduction is effected for the purpose of making the transporting speed in conformity with the processing speed in the development process in the processor 16 constituting the post-processing.

The sheet members P transported in two lines parallel to each other are discharged through a discharge opening (not shown) and are supplied to the adjacent processor 15 by the transport roller pairs 56. In a like manner, the sheet members $P_L$ transported in a single line are discharged through the discharge opening and are supplied to the processor 15 by the transport roller pairs 56.

The operation of the delivery section 32 is controlled by a control signal supplied from the control section 34.

The control section 34 is connected to multiple sensors, such as the position detection sensors described above arranged in the image forming apparatus 10, and receives detection signals from these sensors, thereby generating control signals for controlling the operations and processing at the respective sites that are the supply section 20, the cutter 38, the back print section 22, the registration section 24, the exposure section 26, the sub scanning reception section 28, the distribution unit 30, and the delivery section 32. Then, the control section 34 sends the generated control signals to the respective sites. For instance, the control section 34 receives detection signals from the exposure section 26, the distribution unit 30 and the delivery section 32 and controls a series of operations including the exposure, distribution, transport, and governing based on the detection signals. Note that in FIG. 1, the illustration of connection between the control section 34 and the respective sites through wiring is omitted.

Also, in the image forming apparatus 10, an automatic recognition processing section may be provided which recognizes the currently mounted distribution unit 30, which is replaceable without changing the first transport speed, and the currently mounted unification unit 18, which is replaceable without changing the second transport speed, and automatically changes the setting of the control section 34 in accordance with the kind of the distribution unit 30, the kind of the unification unit 18, and the output amount (number of sheet members to be printed per unit time) of the image forming apparatus 10. This automatic recognition processing section may be provided in the control section 34 or may be provided as an independent section.

The processor 15 is provided on the downstream side of the delivery section 32 and the exposed sheet members P are subjected to development processing in this processor 15.

Figure 11:
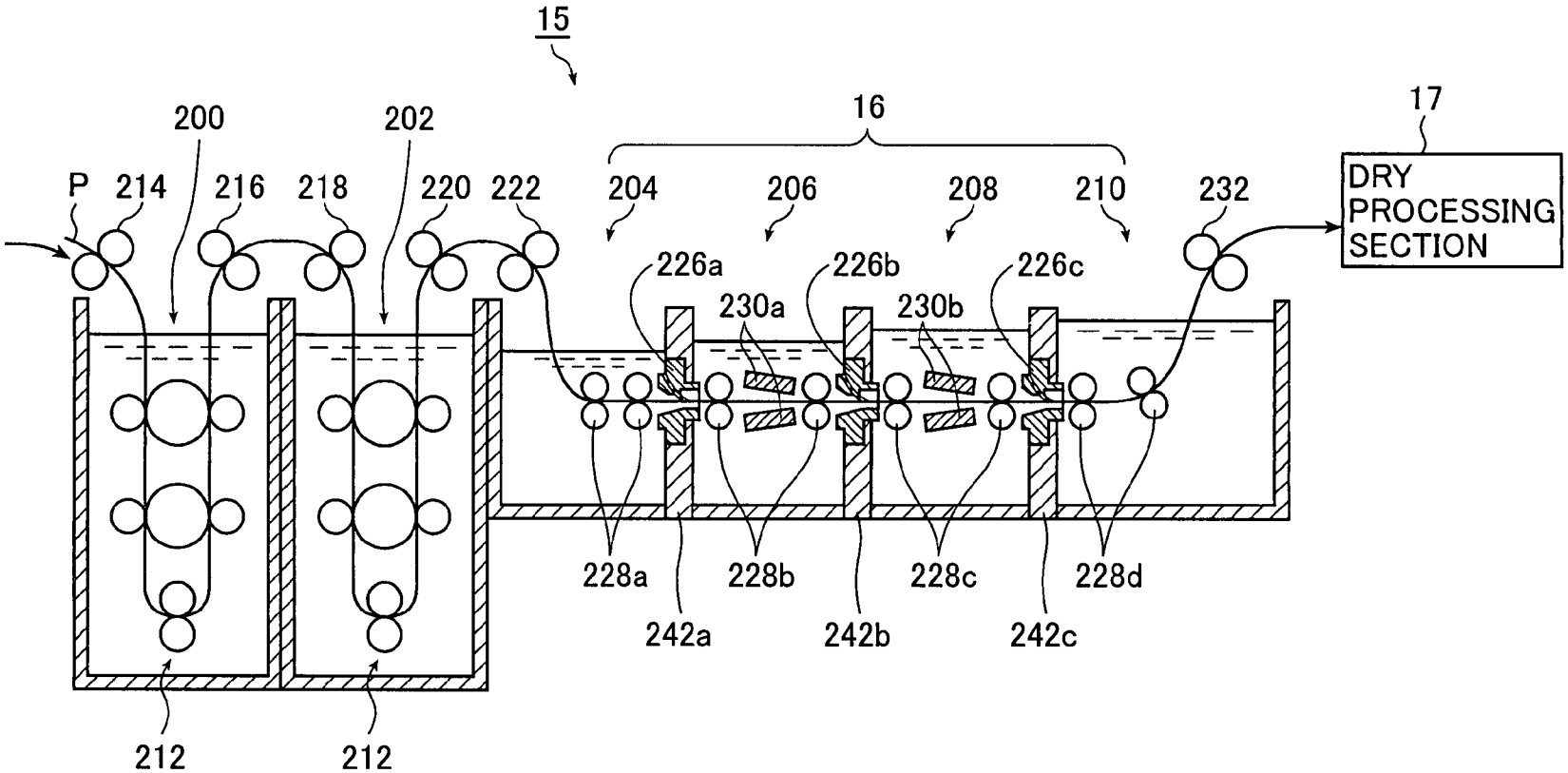
FIG. 11 is a sectional view schematically showing the construction of an embodiment of a processor used in the image forming apparatus shown in FIG. 1.

FIG. 11 is a schematic cross-sectional view schematically showing a construction of the processor of the image forming apparatus in this embodiment.

As shown in FIG. 11, the processor 15 includes a development processing section 16 and a dry processing section 17 and the sheet members P are develop-processed and dried in these sections, thereby obtaining prints. As this processor 15, it is possible to use an automatic development apparatus disclosed in JP 2002-55422 A, for instance. This automatic development processing apparatus has a submerged transport structure for a photosensitive material where it is possible to prevent solution leakage between processing vessels with reliability using a less number of components.

As shown in FIG. 11, in the development processing section 16, a development vessel 200, a fixation and bleaching vessel 202, a first rinse vessel 204, a second rinse vessel 206, a third rinse vessel 208, and a fourth rinse vessel 210 are provided along a horizontal direction in this order from the upstream side in the transport direction of the sheet members P. The dry processing section 17 is provided on a downstream side of the fourth rinse vessel 210.

A predetermined amount of a developing solution is reserved in the development vessel 200 and a predetermined amount of a fixation and bleaching solution is reserved in the fixation and bleaching vessel 202.

In each of the development vessel 200 and the fixation and bleaching vessel 202, a transport apparatus 212 is provided which is composed of multiple rollers that transport the sheet members P in the vessel in an approximately U-letter shape.

Provided above the development vessel 200 are a nip roller pair 214 for transporting the sheet members P into the development vessel 200 and a nip roller pair 216 for transporting the sheet members P subjected to the development processing to a fixation and bleaching vessel 202 side.

Further, provided above the fixation and bleaching vessel 202 are a nip roller pair 218 for transporting the sheets P transported from the development vessel 200 side into the fixation and bleaching vessel 202 and a nip roller pair 220 for transporting the sheet members P subjected to the fixation processing to the first rinse vessel 204 side.

On the other hand, a predetermined amount of rinse water is reserved in each of the first rinse vessel 204, the second rinse vessel 206, the third rinse vessel 208, and the fourth rinse vessel 210.

A nip roller pair 222 for transporting the sheet members P subjected to the fixation processing into the first rinse vessel 204 is provided above the first rinse vessel 204.

Also, photosensitive-material passage members 226*a*, 226*b*, and 226*c*, through which the sheet members P are capable of passing but the solutions reserved in the vessels are incapable of passing, are respectively provided for a partition wall 242*a* between the first rinse vessel 204 and the second rinse vessel 206, a partition wall 242*b* between the second rinse vessel 206 and the third rinse vessel 208, and a partition wall 242*c* between the third rinse vessel 208 and the fourth rinse vessel 210. Each of these photosensitive-material passage members 226*a*, 226*b*, and 226*c* has a blade and prevents the passage of the solutions using the blade after the passage of the sheet members P.

Also, in the first rinse vessel 204, the second rinse vessel 206, the third rinse vessel 208, and the fourth rinse vessel 210, nip roller pairs 228*a*, 228*b*, 228*c*, and 228*d* are provided as transport means for transporting the sheet members P, respectively. In the second rinse vessel 206 and the third rinse vessel 208, guide plate pairs 230*a* and 230*b* are provided, respectively.

In this processor 15, the sheet members P are first immersed in the developing solution in the development vessel 200 and then are immersed in the fixation solution in the fixation and bleaching vessel 202. Following this, the sheet members P are transported to the first rinse vessel 204. Note that in this embodiment, the sheet members P are transported at a predetermined transport speed (second transport speed) under a state where their recording surfaces (emulsion surfaces) are directed upward and their non-recording surfaces are directed downward.

The sheet members P sent into the first rinse vessel 204 are rinsed with the rinse water reserved in the first rinse vessel 204.

The sheet members P rinsed in the first rinse vessel 204 are transported toward the second rinse vessel 206 by the nip rollers 228*a*, pass through the photosensitive-material passage member 226*a*, and are introduced into the second rinse vessel 206.

Following this, the sheet members P pass through the respective photosensitive-material passage members 226*b* and 226*c* in a like manner, are rinsed with the rinse water in each of the second rinse vessel 206, the third rinse vessel 208, and the fourth rinse vessel 210, and are transported to the dry processing section 17 by a nip roller pair 232. Then, the sheet members P are dried in the dry processing section 17.

It should be noted here that in the processor 15 in this embodiment, replenishing of the rinse water is performed using a so-called cascade system and fresh rinse water is supplied into the fourth rinse vessel 210 on the most downstream side in the transport direction of the sheet members P in accordance with the processing amount of the sheet members P, for instance.

Next, the dry section 17 will be described. This dry section 17 is a site where the sheet members P subjected to the development processing are dried.

In this dry section 17, for instance, a heater (not shown) and a blower (not shown) are provided and air heated by the heater is blown onto the sheet members P as hot air using the blower, thereby drying the sheet members P.

The unification unit 18 is connected to the dry processing section 17 and the sorter 19 is connected to the unification unit 18.

Referring again to FIG. 1, the unification unit 18 is a site where the sheet members P transported in plural lines are unified into a single line and the unified sheet members P are transported. To do so, the unification unit 18 includes a transport device 302 and a unification device 304. In the unification unit 18 of this embodiment, sheet members transported in two lines are unified into a single line and are transported. The unification unit 18 is constructed in the form of a replaceable unification unit having a unification processing capacity corresponding with the output amount of the image forming apparatus 10, and the unification speed, at which the sheet members P are unified, of the unification unit 18 is adjustable. This unification speed is adjusted by the control section 34. Note that a second mount portion, to which the unification unit 18 is mounted, is provided for the processor 15. The unification unit 18 is demountably mounted to this second mount portion.

The transport unit 302 includes multiple transport roller pairs 70 to 80. By the transport roller pairs 70, 71, 72, and 74, a transport path a is formed which transports the sheet members P transported in plural lines from the printer 14. Also, by the transport roller pairs 70, 71, 76, 78, and 80, a transport path β is formed which transports the sheet members PL transported in a single line from the printer 14. At an outlet port 82 of this transport path β, an accumulation tray 86 is provided.

Also, the sheet members P transported in the transport path α and discharged from an outlet port 84 of the transport unit 302 are transported by the unification unit 304.

Next, the unification unit 18 and the sorter 19 will be described in more detail with reference to FIG. 12.

Figure 12:
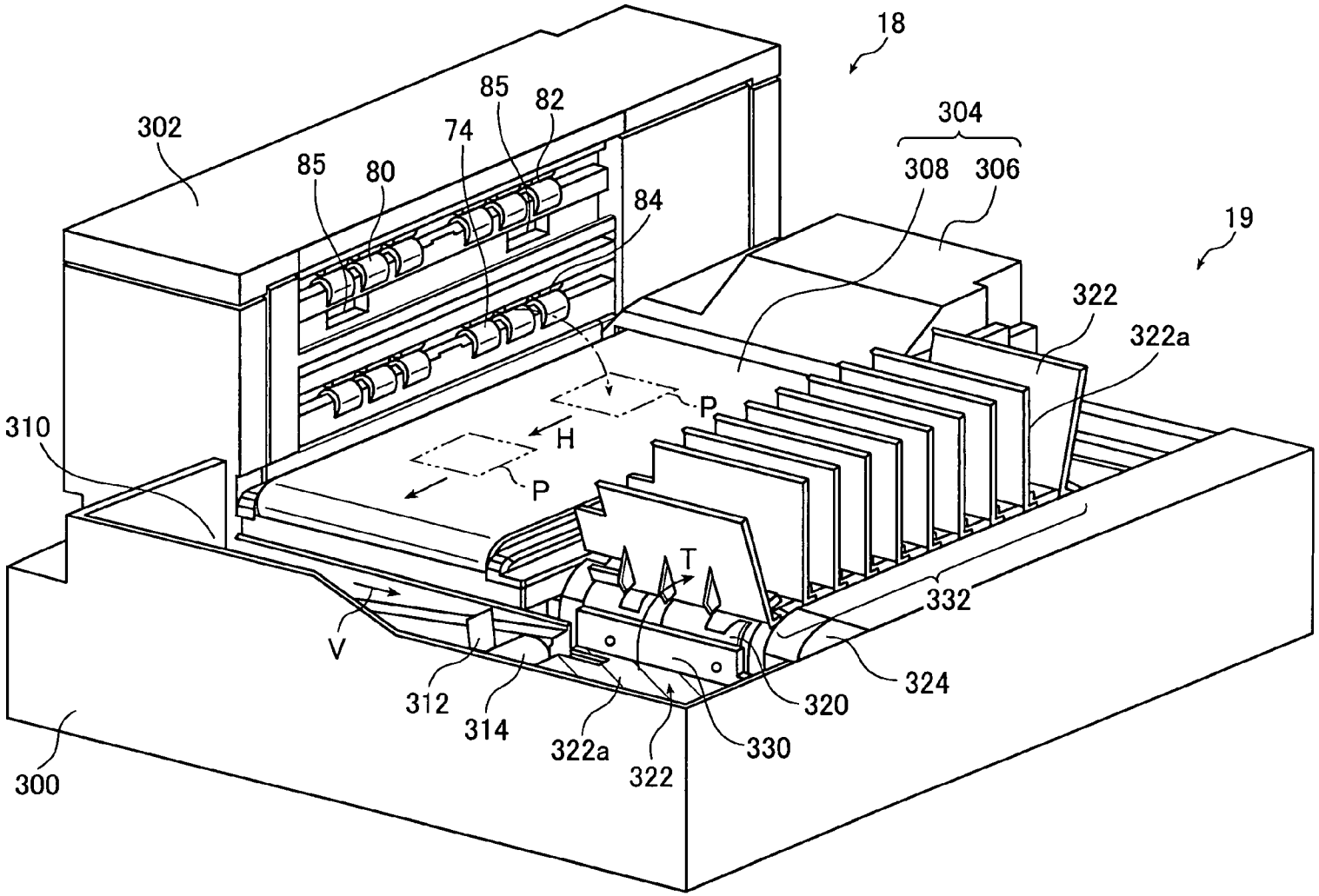
FIG. 12 is a perspective view schematically showing an embodiment of a unification unit and a sorter applied to the image forming apparatus shown in FIG. 1.

FIG. 12 is a schematic perspective view showing the unification unit and the sorter of the image forming apparatus according to this embodiment of the present invention.

As shown in FIG. 12, the unification unit 18 and the sorter 19 are provided in a housing 300.

The unification unit 18 includes the transport unit 302 and the unification unit 304, with the unification unit 304 being provided adjacent to the transport unit 302.

The unification unit 304 is a unit for transporting the sheet members P in a direction orthogonal to the discharge direction of the transport unit 302, and includes a drive portion 306 and a conveyer belt 308. Note that at the outlet port 82 of the transport unit 302, attachment openings 85 for the accumulation tray 86 are established.

The drive portion 306 is a portion that drives the conveyer belt 308 at a predetermined speed. With this drive portion 306, it is possible to drive the conveyer belt 308 while performing switching between a normal speed and a speed that is three times as fast as the normal speed, for instance.

The conveyer belt 308 is arranged so that its transport direction becomes orthogonal to a direction in which the sheet members P are discharged from the outlet ports 82 and 84 of the transport unit 302.

The sorter 19 includes a horizontal sorter unit 310, a standby portion 330, and an accumulation portion 332.

The horizontal sorter unit 310 is a unit for transporting the sheet members P in a direction orthogonal to the transport direction of the conveyer belt 308, is provided adjacent to the unification unit 304 in an end portion of the conveyer belt 308, and includes a stopper 312 and a transport belt 314.

When sheet members P in one lot (sheet members corresponding to one roll of film, for instance) are transported by the conveyer belt 308 and are accumulated in the horizontal sorter unit 310, for instance, the sheet members P in one lot are collectively transported to the standby portion 330.

The stopper 312 is provided so as to be movable in a horizontal direction and controls the transporting of the sheet members P to the standby portion 330 by keeping the sheet members P or releasing them.

The transport belt 314 collectively transports the sheet members P in one lot to the standby portion 330, for instance.

The accumulation portion 332 in the sorter 19 includes a chain 320, multiple trays 322 attached to the chain 320, and a drive portion 324 for driving the chain 320.

The trays 322 are each a plate-shaped member having a size with which it is possible to place the sheet members P thereon. The multiple trays 322 are provided across the whole circumference of the chain 320 so as to be freely rocked. The trays 322 are each set so that its surface 322*a* extends horizontally in the standby portion 330 and extends vertically in the accumulation portion 332.

By driving the chain 320 with the drive portion 324, the trays 322 are rotated in a direction T and the surface 322*a* of the tray 322 in the standby portion 330 is set so as to extend vertically. With this construction, it becomes possible to reduce a space occupied by the accumulation portion 332.

When the sheet members P in one lot are transported by the conveyer belt 308 and are accumulated in the horizontal sorter unit 310, the stopper 312 is pushed by the accumulated sheet members P and the sheet members P are transported to the sorter 19 by the transport belt 314. When the sheet members P in one lot are transported to the tray 322 in the standby portion 330 by the transport belt 314 of the horizontal sorter unit 310 and are accumulated on the surface 322*a* of the tray 322, the chain 320 is driven. As a result, the tray 322 is rotated in the direction T and is moved to the accumulation portion 332 and the next tray 322 is set in the standby portion 330.

The trays 322 are provided across the whole circumference of the chain 320 as described above, so that when the tray 322 currently existing in the standby portion 330 is moved to the accumulation portion 332, the next tray 322 is set in the standby portion 330.

With this construction, when sheet members P in one lot are accumulated on the tray 322 in the standby portion 330, the chain 320 is driven by a certain degree, the sheet members P on the tray 322 are transported to the accumulation portion 332, and the next tray 322 is set in the standby portion 330.

The required performance of the unification unit 18 in this embodiment are determined by the output amount of the image forming apparatus 10 and replacement of the unification unit 18 is possible in accordance with the output amount with no necessity to change the transport speeds. For instance, when the distribution unit 30 does not distribute sheet members and the sheet members are transported in a single line, a construction may be used in which the unification unit 304 and the horizontal sorter unit 310 are not provided and the sheet members are transported directly to the sorter 19 from the transport unit 302.

It should be noted here that the sorter 19 collects and accumulates the sheet members in units of lots in this embodiment, although the present invention is not specifically limited to this. That is, it is sufficient that the number of sheet members collected and accumulated by the sorter 19 is determined as appropriate in accordance with the output amount (number of sheet members to be printed per unit time) of the image forming apparatus, costs, or the like. In the image forming apparatus 10 in this embodiment, the sorter 19 is also replaceable, as described above.

The image forming apparatus 10 is constructed as described above. In the image forming apparatus 10 in this embodiment, the distribution unit 30 is replaceable with no necessity to change the transport speed of the sheet members P in the printer 14 and the unification unit 18 is replaceable with no necessity to change the transport speed of the sheet members P in the processor 15.

Next, an operation of the image forming apparatus 10 in this embodiment will be described.

In the image forming apparatus 10 in this embodiment shown in FIG. 1, first, the photosensitive material A is drawn out by the drawing-out roller pair 21*a* or 21*b* from the magazine 20*a* or 20*b* loaded into the supply section 20 by a predetermined length and is cut into a sheet by the cutter 38.

On this sheet member, a back print is recorded in the back print section 22. Following this, the sheet member is transported upward along the transport path and reaches the registration section 24. In this registration section 24, the skewing and the position in the main scanning direction of the sheet member are adjusted so that the sheet member is arranged at a predetermined widthwise-direction position in the transport path without being slanted with respect to the transport path. The transport direction of the sheet member having passed through the registration section 24 is changed from the upward direction to the horizontal direction and the sheet member is further transported to the exposure section 26.

In the exposure section 26, when the leading end of the sheet member passes through the position detection sensor 50, a detection signal is sent from the position detection sensor 50 to the control section 34 and the exposure unit 36 is turned on to emit the light beam L. As a result, exposure-recording is started.

The exposed sheet member is transported to the distribution unit 30 by the sub scanning reception section 28 without giving a shock to the sheet member.

In the distributing portion 30, the moving member 108, for example, is on standby at the center position, and the transporting rollers 114*a* and 114*b* are constantly rotating. When the size (width) of the sheet members being transported is one requiring distribution, the driving motor is rotated to effect distribution in either the transporting path F or the transporting path R. At this time, since the pipe slide 130 is used in this embodiment, it is possible to simultaneously perform the transport in the main scanning direction (which is perpendicular to the transporting direction) and the transport in the sub scanning direction (transporting direction). That is, it is possible to transport the sheet members in the transporting direction while distributing them. Further, since no driving means such as a motor is provided on the pipe slide 130, it is possible to achieve a reduction in mass and increase the moving speed of the moving member in the main scanning direction (that is distribution speed), and, furthermore, it is also possible to avoid a problem such as step-out.

Further, when sheet members of a size (width) requiring distribution are successively transported, they are transported while being alternately distributed to the transporting path F and the transporting path R. Since the transporting rollers 114*a* and 114*b* are constantly rotating, there is no need to stop the sheet members, and it is possible to restrain a reduction in the transporting speed, whereby it is also possible to achieve an improvement in terms of transporting efficiency. In this case, the slope 156*a* of the guide member 156 is at a position spaced apart by a distance larger than the distributing width, so that there is no fear of the nipping being canceled. It is also possible to detect the end portions in the main scanning direction of the sheet members, move the moving member 108 by an amount according to the end portions and restore it to the home position.

In the delivery section 32, sheet members P distributed to the respective transport paths F and R by the distribution unit 30 are transported separately from each other.

For instance, the sheet members P (see FIG. 10) distributed to the transport path R are transported therethrough while being nipped by the nip roller pairs 50*b* and 52*b* and are further transported by the speed governor roller pairs 54*a*. When the leading end portion of each sheet member P (see FIG. 10) is detected by the sensor 60*c*, the transport speed of the speed governor roller pair 54*b* is reduced from 100 (mm/sec) to 45.3 (mm/sec), for instance. In this manner, adjustment to the transport speed in the processor 15 is performed and the sheet member P is transported to the processor 15 by the transport roller pairs 56 at a predetermined transport speed.

Also, as to the sheet members P (see FIG. 10) distributed to the transport path F, it is possible to transport these sheet members P in the same manner as in the case of the transport path R.

In the case of the sheet members $P_L$ (see FIG. 10) having a size with which the distribution in the distribution unit 30 is not performed, the moving member 108 (see FIG. 2) is moved to the slope 156*a* (see FIG. 6) existing outside the distribution range. Consequently, the driven member 144 (see FIG. 6) climbs up the slope 156*a* and the nip rollers 115*a* and 117*b* and the nip rollers 115*b* and 117*a* (see FIG. 6) are spaced apart from the transport rollers 114*a* and 114*b* (see FIG. 6). As a result, a nip canceling is effected and the sheet members $P_L$ are allowed to pass through the distribution unit without being distributed.

Then, the exposed sheet members P transported from the printer 14 in plural lines are transported through the processor 15 in a submerged manner while maintaining their distribution state into the plural lines and are subjected to development processing in the processor 15. Following this, the sheet members are dried in the dry processing section 17 and are transported to the unification unit 18. In the unification unit 18, the sheet members P distributed into the plural lines are transported in the transport path α of the transport unit 302 and are discharged to the conveyer belt 308 of the unification unit 304 through the outlet port 84. Next, the transport speed by the conveyer belt 308 is increased to a speed that is ten times as fast as an ordinary transport speed and the sheet members P are transported to the horizontal sorter unit 310. That is, each time a sheet member P is transported to the unification unit 304, the transport speed of the conveyer belt 308 is changed. In this manner, the sheet members P transported in plural lines are transported to the horizontal sorter unit 310 in the same order as the order before being distributed into the plural lines in the distribution unit 30.

Next, when sheet members P in one lot have been transported to the horizontal sorter unit 310, the stopper 312 is pushed aside, and the sheet members are transported to the tray 322 set in the standby portion 330 by the transport belt 314. That is, the sheet members P are transported to the sorter 19.

Then, when the sheet members P in one lot are accumulated on the surface 322*a* of the tray 322, the chain 320 is driven, the tray 322 is moved to the accumulation portion 332, and the next tray 322 is set in the standby portion 330.

On the other hand, when the exposed sheet members $P_L$ are transported from the printer 14, these sheet members $P_L$ are transported through the processor 15 in the submerged manner and are subjected to development processing therein. Then, the sheet members are dried in the dry processing section 17 and are transported to the unification unit 18. In this case, the sheet members $P_L$ are processed in a single line, so that these sheet members are transported through the transport path β of the transport unit 302 and are accumulated on the accumulation tray 86.

In this manner, the image forming apparatus 10 in this embodiment outputs sheet members P of the photosensitive material A as prints.

As described above, according to the image forming apparatus 10 in this embodiment, the distribution unit 30 and the unification unit 18 are replaceable under a state where the first and second transport speeds in the printer 14 and the processor 15 are maintained constant (invariant). In addition, at least one of the cut intervals of the photosensitive material A, distribution speed, and unification speed of the sheet member P is adjustable by the control section 34. Therefore, it becomes possible to obtain a predetermined performance by selecting the distribution unit 30 and the unification unit 18 in accordance with a required output amount. In addition, it also becomes possible to change the currently set output amount with ease. Here, parameters adjusted by the control section 34 are the cut intervals of the photosensitive material A as well as the distribution speed or the nip canceling operation speed. Also, there is a case where only the unification speed is adjusted by the control section 34. As a result, it is sufficient that the software of the control section 34 is changed in a simple manner.

Also, it is possible to adjust the currently set output amount (currently set number of sheet members to be printed per unit time) by changing the cutting intervals of the photosensitive material A, distribution speed, and unification speed only through adjustment of the control section 34.

As described above, according to the image forming apparatus 10 in this embodiment, the hardware is replaceable and the control section (software) is adjustable in accordance with the output amount, so that it becomes possible to obtain an image forming apparatus that has a desired output amount through minimum replacement of the construction elements and adjustment of the software.

Also, a construction may be obtained in which the internal construction of the image forming apparatus 10 in this embodiment is recognized by an automatic recognition processing section. In this case, for instance, the image forming apparatus is connected to a service center through a network and the specifications of the image forming apparatus are grasped at this service center, which makes it possible to, when a failure occurs to the image forming apparatus, identify an element, which is a cause of the failure, with ease.

Also, when the image forming apparatus 10 in this embodiment is the apparatus for using the photosensitive material A of a width of 310 mm (12 inches), it is possible to set its projection area at 1.3 $m^2$ or less. Also, it is possible to set the transport speed and the projection area of the processor 15 at 30 mm/sec or more and 0.65 $m^2$ or less, respectively.

As described above, according to the image forming apparatus 10 in this embodiment, it is also possible to achieve size reduction while maintaining a sufficient processing capacity.

Next, an image forming apparatus setup system according to an embodiment of the present invention will be described.

The image forming apparatus setup system (hereinafter simply referred to as "setup system") in this embodiment is used to set up the image forming apparatus shown in FIGS. 1 to 12 described above in accordance with a required output amount. This setup system will be described below by referring to FIGS. 1 to 12 again.

As described above, in the image forming apparatus in this embodiment, at least the distribution unit, additionally the unification unit among the various construction elements are replaceable and the control section is adjustable in accordance with the sheet output amount (number of sheets to be printed) per unit time. Further, the sorter is also replaceable.

The setup system in this embodiment is used to set up the image forming apparatus described above and includes a distribution unit group containing multiple kinds of distribution units whose distribution processing capacities have been prescribed based on distribution speeds, a unification unit group containing multiple kinds of unification units corresponding to various output amounts, and adjuster group containing multiple adjusters for adjusting at least one of the sheet supply intervals and the sheet distribution speed controlled by the control section 34 in accordance with the output amount.

In the setup system in this embodiment, the construction elements of the image forming apparatus other than the replaceable distribution unit, unification unit, and sorter are not changed.

Here, there is a case where an image forming apparatus that does not perform distribution is set up with the setup system in this embodiment, so that the distribution unit group contains a single-line transport unit that does not perform distribution. For instance, this distribution unit group contains the single-line transport unit, a distribution unit for low-speed distribution, a distribution unit for middle-speed distribution, and a distribution unit for high-speed distribution. As the distribution units for low-speed distribution and middle-speed distribution, the distribution unit 30*a* shown in FIG. 8 is suited. Also, as the distribution units for middle-speed distribution and high-speed distribution, the distribution unit 30 shown in FIG. 2 is suited. In this manner, the distribution processing capacity of each distribution unit is prescribed based on a distribution speed.

Also, the unification unit group contains a single-line transport unit in order to cope with a case where distribution is not performed and therefore unification is not required. An example of unification units contained in the unification unit group is the unification unit shown in FIG. 12 described above. The unification speed of each unification unit is adjustable and the transport speed in the processor 15 is lower than the transport speed in the printer 14, so that it is sufficient that the number of kinds of unification units prepared for the unification unit group is smaller than the number of kinds of distribution units of the distribution unit group. Also, when the unification unit (single-line transport unit) that does not perform unification is used, sheet members may be accumulated directly on the sorter from the unification unit.

The adjuster group means a group containing multiple adjustment parameters (adjusters) for adjusting at least one of the sheet cutting intervals (sheet supply intervals) and the sheet distribution speed controlled by the control section 34 in accordance with a required output amount. This adjuster group may contain an adjustment parameter for adjusting the unification speed of the unification unit.

The image forming apparatus 10 is capable of adjusting its output amount by adjusting at least one of the sheet cutting intervals (sheet supply intervals) and the sheet distribution speed.

In the setup system in this embodiment, the distribution unit 30 and the unification unit 18 are replaceable, and the control section 34 is adjustable in accordance with the kinds of the distribution unit 30 and the unification unit 18. As a result, it becomes possible to set up an image forming apparatus corresponding with a required output amount (required number of sheets to be printed) only through minimum unit replacement and control section adjustment.

In the setup system in this embodiment, various combinations of distribution units, unification units, sorters, and adjusters may be set in advance in accordance with the operation speeds (distribution speeds) or transport forms of the distribution units. Examples of the combinations are shown in Table 1 given below. In Table 1, Class 1 to Class 4 are shown as examples and the output amount (number of sheets to be printed per unit time) is increased in the order of Class 1 to Class 4.

TABLE 1

| | Class 1 | Class 2 | Class 3 | Class 4 |
|---|---|---|---|---|
| Distribution unit | Single-line transport | Low-speed operation | Middle-speed operation | High-speed operation |
| Unification unit | None | Low-speed operation | Middle-speed operation | High-speed operation |
| Sorter | Single-line sorter | Unification sorter | Unification sorter | Unification sorter |
| Sheet supply interval | Short | Long | Medium | Short |
| Processing capacity | Low | Middle | High | Maximum |

In this manner, various combinations of distribution units, unification units, sorters, and adjusters (supply intervals) may be set in advance and selection from among these combinations may be performed.

It should be noted here that in this embodiment, if a distribution unit that is capable of performing a middle-speed operation and a high-speed operation is used, for instance, the setting of the distribution speed of the distribution unit may be changed in accordance with the output amount. Also, single-line transport may be performed by setting the distribution unit so as not to perform distribution.

Also, an automatic recognition processing section may be used which automatically recognizes a selected distribution unit. In this case, based on a result of the recognition, the automatic recognition processing section selects at least one of the sheet supply intervals and the distribution speed of the distribution unit adjusted based on the adjuster. Then, the automatic recognition processing section selects an optimum set value for the selected supply intervals and/or distribution speed and changes the setting of the control section 34. In this case, the unification speed of the unification unit is also adjusted by the automatic recognition processing section in accordance with the output amount of the image forming apparatus 10.

It should be noted here that in the setup system in this embodiment, a user may determine an output amount (number of sheets to be printed per unit time) of the image forming apparatus in accordance with the size of his/her laboratory shop or the like and select the distribution unit, the unification unit, and the adjuster in accordance with the output amount, for instance.

Further, when the laboratory shop is downsized or upsized, it is possible to cope with this situation without buying a new apparatus. That is, it is possible to adjust the currently set output amount of the image forming apparatus in accordance with a new required output amount by replacing at least one of the distribution unit and the unification unit, adjusting at least one of supply intervals and a distribution speed of the distribution unit using the adjuster, and adjusting the unification unit.

It should be noted here that in this embodiment, at least the distribution unit is replaceable, so that it becomes possible to set up the image forming apparatus 10 so as to correspond with the required output amount.

Next, an image forming apparatus setup method according to an embodiment of the present invention will be described with reference to FIG. 13. The image forming apparatus setup method in this embodiment is a method with which a predetermined image forming apparatus is set up using the setup system described above.

Figure 13:
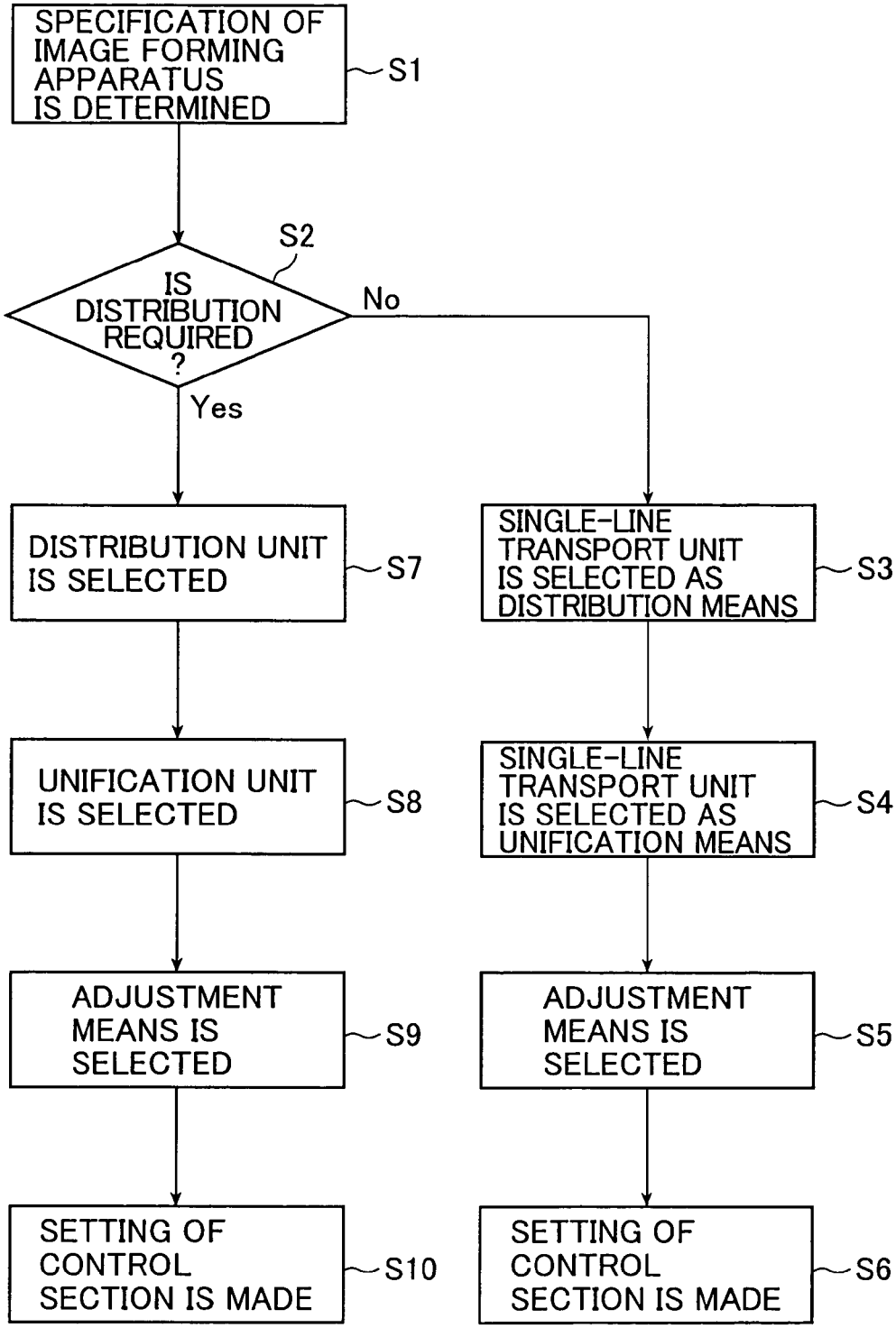
FIG. 13 is a flowchart showing an image forming apparatus setup method of the image forming apparatus shown in FIG. 1 in the order of processing steps.

FIG. 13 is a flowchart showing the image forming apparatus setup method according to the embodiment of the present invention in the order of processing steps. In this embodiment, it is assumed that a distribution unit is selected from the distribution unit group, an adjuster is selected from the adjuster group, and a unification unit is selected from the unification unit group.

First, the specifications of an image forming apparatus to be set up are determined (step S1). The specifications of the image forming apparatus mean, for instance, a sheet output amount per unit time showing how many sheets having a predetermined size are to be printed per unit time.

Next, it is judged whether distribution is required based on the determined specifications of the image forming apparatus (step S2).

Then, if it is judged in step S2 that distribution is not required, the single-line transport unit is selected from the distribution unit group as the distributor (step S3).

Following this, the single-line transport unit is selected from the unification unit group as the unificator (step S4).

Next, in accordance with the specifications of the image forming apparatus, an adjuster is selected from the adjuster group (step S5). Then, at least one of supply intervals and a distribution speed is set in the control section based on the selected adjuster (step S6). In this manner, the image forming apparatus is set up.

On the other hand, if it is judged in step S2 that distribution is required, a distribution unit corresponding with the print output amount is selected from the distribution unit group (step S7).

Next, a unification unit corresponding with the print output amount is selected from the unification unit group (step S8).

Then, in accordance with the specifications of the image forming apparatus, an adjuster is selected from the adjuster group (step S9). Following this, at least one of supply intervals and a distribution speed is set in the control section based on the selected adjuster (step S10).

In this embodiment, it is possible to set up an image forming apparatus corresponding with the specifications determined in step S1 in this manner.

Also, with the image forming apparatus setup method according to the present invention, even when a laboratory shop is upsized or downsized and the required output amount of the image forming apparatus is increased or decreased, it is possible to cope with this situation by performing adjustment of the distribution unit, unification unit, and the control section in steps S1 to S10 described above. As a result, it becomes possible to eliminate the necessity to return the image forming apparatus to a factory and modify it, for instance.

In this case, when an image forming apparatus that uses a distribution unit should be changed so that distribution is not performed, it is possible to cope with this situation by changing the control of the distribution unit so as not to perform distribution.

Also, as to the unification unit, when a change to specifications where distribution is not performed should be made, it is possible to cope with this situation by setting the unification unit so as not to perform unification like in the case of the distribution unit.

Further, when the output amount of an image forming apparatus that uses a distribution unit should be increased, it is possible to cope with this situation by increasing the distribution speed of the distribution unit. On the other hand, when the output amount should be decreased, it is possible to cope with this situation by performing adjustment so that the distribution speed of the distribution unit is lowered or the distribution unit does not perform its distribution operation, for instance.

In this manner, in this embodiment, it is possible to change the output amount of an image forming apparatus by changing the distribution speed of the distribution unit controlled by the control section, which eliminates the necessity to replace the distribution unit or the unification unit. As a result, it becomes possible to change the print output amount of the image forming apparatus at low cost in accordance with specifications of the image forming apparatus.

In addition, it is also possible to change the print output amount merely by setting the sheet supply intervals again, in accordance with the capacity of the distribution unit and the unification unit.

It should be noted here that the present invention is not limited to the setup method shown in FIG. 13 and the order, in which the settable and changeable distribution unit, unification unit, and adjusters are determined in accordance with the specifications of the image forming apparatus 10, is not specifically limited.

Also, with the setup method in this embodiment, selection from among the combinations of distribution units, unification units, sorters, and adjusters shown in Table 1 described above may be performed like in the case of the setup system described above.

With the image forming apparatus setup method described above, it becomes possible to design the construction elements other than the distribution unit, the unification unit, and the sorter as common construction elements and to set up an image forming apparatus group containing multiple image forming apparatuses in each of which the same first transport speed of a printer and the same second transport speed of a processor are used. This image forming apparatus group contains three or more kinds of image forming apparatuses that each have the same construction as to the construction elements other than the distribution unit, the unification unit, and the sorter. In this case, needless to say, the respective image forming apparatuses in the image forming apparatus group are capable of mutually changing their specifications.

In such an image forming apparatus group, it is unnecessary to design large apparatuses, such as a printer and a processor, specifically for each image forming apparatus. Therefore, it becomes possible to significantly reduce the development expense of the image forming apparatus group. In addition, multiple components and units of different kinds of image forming apparatuses are set as common components and units, so that it becomes possible to reduce the cost of each image forming apparatus.

Also, in order to produce the three or more models of image forming apparatuses having different specifications in the image forming apparatus group, only the adjustment of the control section is required as the changing of software. As a result, it becomes possible to significantly reduce the development expense of the software.

Up to this point, the image forming apparatus, the image forming apparatus setup system, and the image forming apparatus setup method according to the present invention have been described in detail, although the present invention is not limited to the embodiments described above and it is of course possible to make various modifications and changes without departing from the gist of the present invention. For instance, instead of sheet members obtained by cutting a rolled photosensitive material into a sheet shape, sheet members produced in advance in a sheet shape having a predetermined size may be supplied to the printer at predetermined supply intervals.

In the embodiments described above, an image forming apparatus group contains multiple image forming apparatuses in each of which the distribution unit is provided downstream in the transport direction of the sheet member from the exposure section in the printer and the sheet member is distributed after being exposed and prior to development processing. However, this invention is not restricted to this construction. It is also possible to construct an image forming apparatus group to contain multiple image forming apparatuses in which distribution units are provided upstream in the transport direction from the exposure section. In this construction, the distribution unit is designed to be replaceable similarly to the embodiments described above.

Also, the image forming apparatus according to the present invention may use a distribution unit capable of distributing sheet members into three or more lines or a distribution unit capable of distributing sheet members into proper number of lines in accordance with the size of a sheet member.

As described in detail above, in the image forming apparatus according to the present invention, the distributors, whose sheet distribution speed is adjustable, is replaceable and at least one of the sheet supply intervals and the distribution speed of the distributor controlled by the control section is adjustable, so that it becomes possible to cope with a required output amount. In addition, in the image forming apparatus according to the present invention, it is also possible to change a currently set output amount per unit time through the replacement of the distributor and the adjustment of the control section, so that it becomes possible to suppress the cost at the time of changing of the currently set sheet output amount.

Also, the image forming apparatus setup system according to the present invention includes a distribution unit group containing multiple kinds of distributors whose distribution processing capacities have been prescribed based on distribution speeds and which include a distributor that does not distribute sheet members into plural lines. As a result, it becomes possible to set up an image forming apparatus corresponding with a required output amount. In addition, it becomes possible to produce models having different output amounts through minimum replacement of units (replacement of the distributor). As a result, it becomes possible to produce different models at low cost.

Further, the image forming apparatus setup method according to the present invention uses a distribution unit group containing multiple kinds of distributors, whose distribution processing capacities have been prescribed based on distribution speeds and which include a distributor that does not distribute sheet members into plural lines, and an adjuster group containing multiple adjusters for adjusting at least one of sheet supply intervals and a sheet distribution speed in accordance with a required output amount. As a result, with this image forming apparatus setup method, it becomes possible to set up an image forming apparatus corresponding with a required output amount through selection of a distribution unit (distributor) from the distribution unit group and through selection of an adjuster from the adjuster group. In addition, it becomes possible to produce models having different output amounts through minimum replacement of units (replacement of the distribution units). As a result, it becomes possible to produce different models at low cost.

What is claimed is:

1. An image forming apparatus, comprising:

a printer that transports sheet members supplied at preset sheet supply intervals at a predetermined first transport speed and performs image printing on the sheet members; and a processor that transports the sheet members subjected to the image printing at a predetermined second transport speed and performs development processing on the sheet members subjected to the image printing, and outputs the sheet members subjected to the development processing, wherein:

said printer includes:

a distributor that distributes the sheet members into plural lines to transport the distributed sheet members in the plural lines in accordance with a sheet output amount per unit time required by said image forming apparatus, while transporting the sheet members at the first transport speed, said distributor being replaceable and having a distribution processing capacity corresponding with the sheet output amount; and a control section that controls in accordance with the sheet output amount at least one of the sheet supply intervals for the sheet members transported at the first transport speed and a sheet distribution speed at which the sheet members are distributed while being transported at the first transport speed when said distributor is capable of adjusting the sheet distribution speed.

2. The image forming apparatus according to claim 1, wherein said processor includes:

a development processing section that performs the development processing on the sheet members subjected to the image printing and transported in the plural lines at the second transport speed; and a unificator that unifies the sheet members which are subjected to the development processing and distributed in the plural lines into a single line, and transports the unified sheet members in the single line, said unificator being replaceable and having a unification processing capacity corresponding with the sheet output amount and being capable of adjusting a unification speed at which the distributed sheet members in the plural lines are unified into the single line.

3. The image forming apparatus according to claim 2, further comprising:

an automatic recognition processing section that recognizes said distributor and said unificator and adjusts at least one of the sheet supply intervals and the sheet distribution speed controlled by said control section in accordance with the sheet output amount.

4. The image forming apparatus according to claim 2, wherein said processor further comprises:

a sorter that is connected to said unificator and sorts the plural sheet members unified by said unificator.

5. The image forming apparatus according to claim 1, wherein said printer includes a supply section, said supply section including:

a magazine in which a long photosensitive material is contained;

a drawing-out unit that draws out the long photosensitive material from said magazine; and a cutter that cuts the long photosensitive material drawn out from said magazine into the sheet members, and wherein the sheet supply intervals controlled by said control section are cutting intervals of the long photosensitive material by said cutter.

6. The image forming apparatus according to claim 1, further comprising:

an automatic recognition processing section that recognizes said distributor and adjusts at least one of the sheet supply intervals and the sheet distribution speed controlled by said control section in accordance with the sheet output amount.

7. An image forming apparatus setup system for setting up an image forming apparatus, said image forming apparatus including:

a printer that transports sheet members supplied at preset sheet supply intervals at a predetermined first transport speed and performs image printing on the sheet members; and a processor that transports the sheet members subjected to the image printing at a predetermined second transport speed and performs development processing on the sheet members subjected to the image printing, and outputs the sheet members subjected to the development processing, wherein:

said printer includes a first mount portion to which distributor is mounted, said distributor distributing the sheet members into plural lines to transport the distributed sheet members in the plural lines in accordance with a sheet output amount per unit time required by said image forming apparatus, while transporting the sheet members at the first transport speed, said distributor being replaceable and having a distribution processing capacity corresponding with the sheet output amount; and said image forming apparatus setup system comprising:

said image forming apparatus; and a distributor group containing plural kinds of distributors whose distribution processing capacities have been prescribed based on sheet distribution speeds at which the sheet members are distributed into the plural lines and a single-line transporter that transports the sheet members in a single line without distributing the sheet members into the plural lines, wherein said image forming apparatus is set up in accordance with the sheet output amount by selecting a distributor corresponding to the sheet output amount from said distributor group and mounting said selected distributor into said first mount portion.

8. The image forming apparatus setup system according to claim 7, wherein said distributor is capable of adjusting the sheet distribution speed at which the sheet members are distributed while being transported at the first transport speed.

9. The image forming apparatus setup system according to claim 8, wherein:

said printer further includes control section that controls at least one of the sheet supply intervals and the sheet distribution speed in accordance with the sheet output amount;

said image forming apparatus setup system further comprises:

an adjuster group containing plural adjusters that adjusts at least one of the sheet supply intervals and the sheet distribution speed controlled by said control section in accordance with the sheet output amount; and an adjuster corresponding to the sheet output amount is selected from said adjuster group, said selected adjuster is set to said control section and said control section controls at least one of the sheet supply intervals and the sheet distribution speed based on said set adjuster.

10. The image forming apparatus setup system according to claim 9, wherein:

said adjuster is adjustment parameters for adjusting at least one of the sheet supply intervals and the sheet distribution speed controlled by said control section in accordance with the sheet output amount, and said adjuster group is an adjustment parameters group containing plural kinds of said adjustment parameters.

11. The image forming apparatus setup system according to claim 7, wherein:

said processor includes:

a development processing section that performs the development processing on the sheet members subjected to the image printing and transported in the plural lines at the second transport speed; and a second mount portion to which unificator is mounted, said unificator unifying the sheet members which are subjected to the development processing and distributed in the plural lines into a single line, and transporting the unified sheet members in the single line, said unificator being replaceable and having a unification processing capacity corresponding with the sheet output amount and being capable of adjusting a unification speed at which the distributed sheet members in the plural lines are unified into the single line; and said image forming apparatus setup system further comprising:

a unificator group containing plural kinds of unificators whose unification processing capacities have been prescribed based on sheet unification speeds corresponding with the different output amounts and a transporter that transports the sheet members without unifying the sheet members; and a unificator corresponding to the sheet output amount is selected from said unificator group and said selected unificator is mounted to said second mount portion.

12. The image forming apparatus setup system according to claim 11, wherein:

said processor further includes a third mount portion which is connected to said unificator and to which a sorter is mounted, said sorter sorting the sheet members unified by said unificator;

said image forming apparatus setup system further comprises:

a sorter group containing plural kinds of sorters for sorting the sheet members unified by said unificator corresponding with the different output amounts; and a sorter corresponding to the sheet output amount is selected from said sorter group and said selected sorter is mounted to said third mount portion.

13. An image forming apparatus setup method for setting up an image forming apparatus, said image forming apparatus including:

a printer that transports sheet members supplied at preset sheet supply intervals at a predetermined first transport speed and performs image printing on the sheet members; and a processor that transports the sheet members subjected to the image printing at a predetermined second transport speed and performs development processing on the sheet members subjected to the image printing, and outputs the sheet members subjected to the development processing, wherein:

said printer includes:

a distributor that distributes the sheet members into plural lines to transport the distributed sheet members in the plural lines in accordance with a sheet output amount per unit time required by said image forming apparatus, while transporting the sheet members at the first transport speed, said distributor being replaceable, having a distribution processing capacity corresponding with the sheet output amount and being capable of adjusting a sheet distribution speed at which the sheet members are distributed into the plural lines while the sheet members being transported at the first transport speed; and a control section that controls in accordance with the sheet output amount at least one of the preset sheet supply intervals and the sheet distribution speed;

said image forming apparatus setup method comprising the steps of:

preparing a distributor group containing plural kinds of distributors whose distribution processing capacities have been prescribed based on sheet distribution speeds at which the sheet members are distributed into the plural lines corresponding with the different output amounts and a single-line transporter that transports the sheet members in a single line without distributing the sheet members into the plural lines, and an adjuster group containing plural adjusters that adjust at least one of the sheet supply intervals and the sheet distribution speed controlled by said control section in accordance with the sheet output amount;

selecting a distributor corresponding to the sheet output amount from said distributor group; and selecting an adjuster corresponding to the sheet output amount from said adjuster group.

14. The image forming apparatus setup method according to claim 13, wherein:

said processor includes:

a development processing section that performs the development processing on the sheet members subjected to the image printing and transported in the plural lines at the second transport speed; and a unificator that unifies the sheet members which are subjected to the development processing and distributed in the plural lines into a single line, and transports the unified sheet members in the single line, said unificator being replaceable and having a unification processing capacity corresponding with the sheet output amount and being capable of adjusting a unification speed at which the distributed sheet members in the plural lines are unified into the single line; and said image forming apparatus setup method further comprising the steps of:

preparing a unificator group containing plural kinds of unificators whose unification processing capacities have been prescribed based on sheet unification speeds corresponding with the different output amounts and a transporter that transports the sheet members without unifying the sheet members; and selecting a unificator corresponding to the sheet output amount from said unificator group.

15. The image forming apparatus setup method according to claim 13, further comprising the steps of:

setting said selected adjuster to said control section, and wherein said control section controls at least one of the sheet supply intervals and the sheet distribution speed based on said set adjuster.

16. The image forming apparatus setup method according to claim 13, wherein:

said adjuster is adjustment parameters that adjusts at least one of the sheet supply intervals and the sheet distribution speed controlled by said control section in accordance with the sheet output amount, and said adjuster group is an adjustment parameters group containing plural kinds of said adjustment parameters.

17. The image forming apparatus setup method according to claim 13, further comprising the steps of:

preparing a sorter group containing plural kinds of sorters being each connected to said unificator and that sorts the sheet members unified by said unificator corresponding with the different output amounts; and selecting a sorter corresponding to the sheet output amount from said sorter group.

18. An image forming apparatus including:

a printer that transports sheet members supplied at preset sheet supply intervals at a predetermined first transport speed and performs image printing on the sheet members; and a processor that transports the sheet members subjected to the image printing at a predetermined second transport speed and performs development processing on the sheet members subjected to the image printing, and outputs the sheet members subjected to the development processing, wherein:

said printer includes:

a distributor that distributs the sheet members into plural lines to transport the distributed sheet members in the plural lines in accordance with a sheet output amount per unit time required by said image forming apparatus, while transporting the sheet members at the first transport speed, said distributor being replaceable, having a distribution processing capacity corresponding with the sheet output amount and being capable of adjusting a sheet distribution speed at which the sheet members are distributed into the plural lines while the sheet members being transported at the first transport speed; and a control section that controls in accordance with the sheet output amount at least one of the preset sheet supply intervals and the sheet distribution speed, and wherein said image forming apparatus is set up with a setup method comprising the steps of:

preparing a distributor group containing plural kinds of distributors whose distribution processing capacities have been prescribed based on sheet distribution speeds at which the sheet members are distributed into the plural lines corresponding with the different output amounts and a single-line transporter that transports the sheet members in a single line without distributing the sheet members into the plural lines, and an adjuster group containing plural adjusters that adjust at least one of the sheet supply intervals and the sheet distribution speed controlled by said control section in accordance with the sheet output amount;

selecting a distributor corresponding to the sheet output amount from said distributor group; and selecting an adjuster corresponding to the sheet output amount from said adjuster group.

* * * * *

UNITED STATES PATENT AND TRADEMARK OFFICE

CERTIFICATE OF CORRECTION

PATENT NO. : 7,029,188 B2
APPLICATION NO. : 10/921985
DATED : April 18, 2006
INVENTOR(S) : Kanenori Ochiai It is certified that error appears in the above-identified patent and that said Letters Patent is hereby corrected as shown below:

Column 6, Line 66:

The line reading "wherein: the printer includes: a distributor that distributs the" should read -- wherein: the printer includes: a distributor that distributes the --

Claim 18, Column 36, Line 13:

The line reading "a distributor that distributs the sheet members into plural" should read -- a distributor that distributes the sheet members into plural --

Signed and Sealed this

Fourteenth Day of October, 2008

JON W. DUDAS
*Director of the United States Patent and Trademark Office*